US007920811B2

(12) United States Patent
Murase et al.

(10) Patent No.: US 7,920,811 B2
(45) Date of Patent: Apr. 5, 2011

(54) STORAGE CONTAINER AND IMAGE FORMING APPARATUS

(75) Inventors: Hirokazu Murase, Kanagawa (JP); Toshikazu Tsumita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 392 days.

(21) Appl. No.: 12/208,935

(22) Filed: Sep. 11, 2008

(65) Prior Publication Data

US 2009/0238608 A1 Sep. 24, 2009

(30) Foreign Application Priority Data

Mar. 24, 2008 (JP) ..... P2008-076782

(51) Int. Cl.
*G03G 15/08* (2006.01)

(52) U.S. Cl. ..... 399/162; 399/222

(58) Field of Classification Search ..... 399/222, 399/262

See application file for complete search history.

(56) References Cited

U.S. PATENT DOCUMENTS

| | | | | |
|---|---|---|---|---|
| 4,937,628 | A | 6/1990 | Cipolla et al. | 355/260 |
| 5,111,976 | A | 5/1992 | Ban | 222/485 |
| 7,792,469 | B2 * | 9/2010 | Ichikawa et al. | 399/262 |
| 2002/0064401 | A1 * | 5/2002 | Ashikari | 399/258 |
| 2007/0104505 | A1 | 5/2007 | Murakami et al. | 399/106 |
| 2009/0129827 | A1 * | 5/2009 | Ichikawa et al. | 399/262 |

FOREIGN PATENT DOCUMENTS

JP 2000-187378 7/2000

* cited by examiner

*Primary Examiner* — David M Gray
*Assistant Examiner* — G. M. Hyder
(74) *Attorney, Agent, or Firm* — Morgan, Lewis & Bockius LLP

(57) ABSTRACT

A storage container includes: a storage container main body; a flow-out opening; a shutter; a seal member; a restricting portion; and an open-close movement restricting portion.

6 Claims, 23 Drawing Sheets

STORAGE CONTAINER AND IMAGE FORMING APPARATUS

CROSS-REFERENCE TO RELATED APPLICATIONS

This application is based on and claims priority under 35 U.S.C. 119 from Japanese Patent Application No. 2008-076782 filed Mar. 24, 2008.

BACKGROUND

1. Technical Field

The present invention relates to a storage container and an image forming apparatus.

2. Related Art

Conventionally, as a technology relating to a storage container, that is, a so called toner cartridge, there is known a technology which is disclosed in 2000-187378 (the term "JP-A" as used herein means an "unexamined published Japanese patent application").

SUMMARY

According to an aspect of the present invention, a storage container includes: a storage container main body that stores an image forming material therein; a flow-out opening that flows out the image forming material stored in the storage container main body; a shutter that is supported to be movable between an opening position, which opens the flow-out opening and a closing position, which closes the flow-out opening; a seal member that, in a case where the shutter is disposed at the closing position, is interposed between the flow-out opening and the shutter and is elastically deformed by the shutter in a thickness direction thereof along the flow-out direction of the image forming material so as to seal the flow-out opening; a restricting portion that is supported on the shutter; and an open-close movement restricting portion that, in a state where the shutter is moved to the closing position, is disposed at a position opposed to the restricting portion, and that, in a case where the shutter moved to the closing position is pressed from outside and the seal member is thereby elastically deformed further in the thickness direction, is disposed at a position overlapping with the leading end position of the restricting portion along a moving direction of the shutter and, in a case where no external force is applied to the shutter, is disposed at a position not overlapping with the leading end position of the restricting portion along the moving direction of the shutter.

BRIEF DESCRIPTION OF THE DRAWINGS

Exemplary embodiment of the present invention will be described in detail based on the following figures, wherein:

FIG. 10 is an explanatory view of the length relationship between a flow-out opening forming portion and a shutter. Specifically.

FIG. 11 is an explanatory view of the position relationship of the shutter to the flow-out opening forming portion 34, specifically.

DETAILED DESCRIPTION

Figure 1:
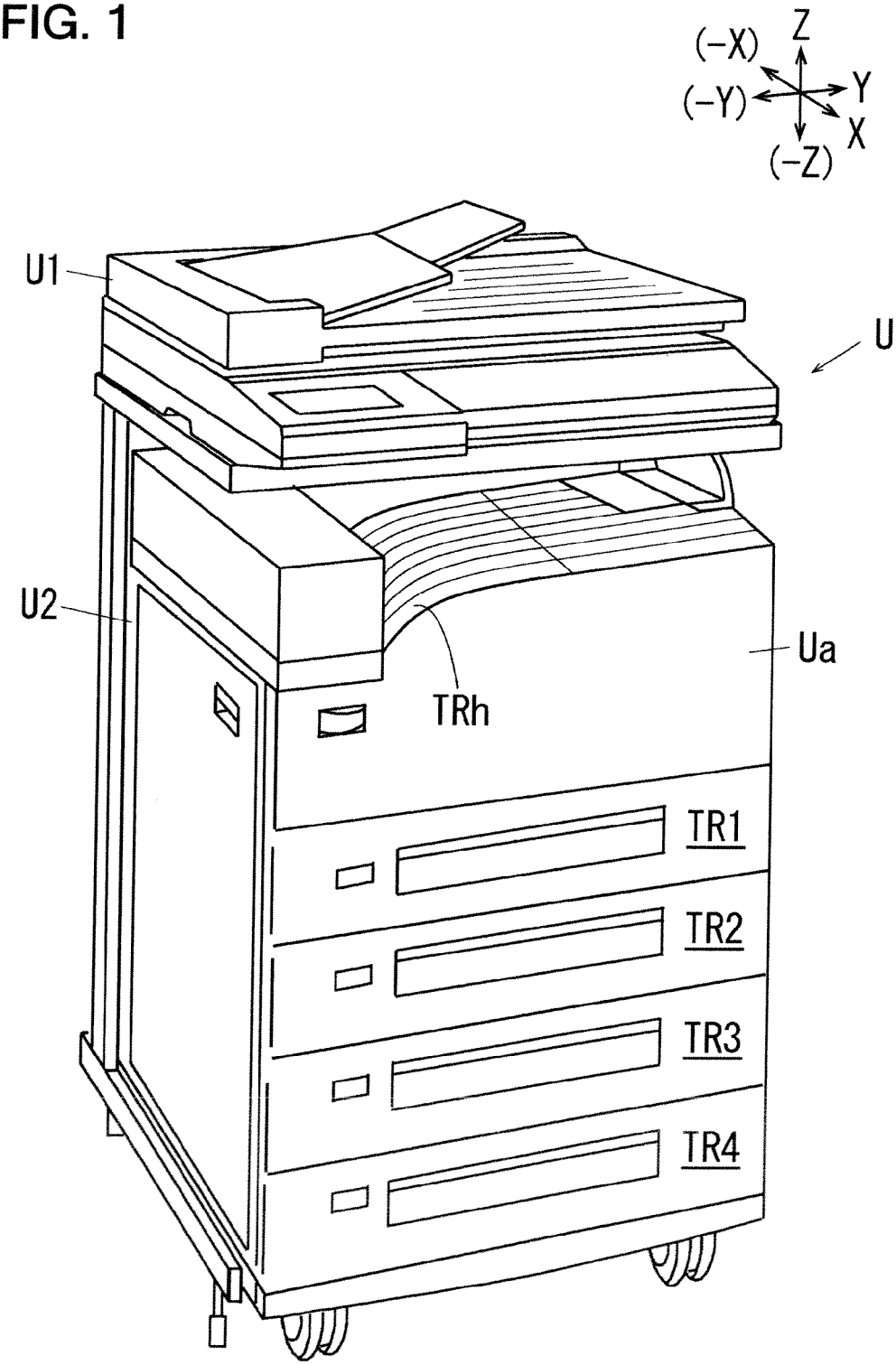
FIG. 1 is a perspective view of an image forming apparatus according to an embodiment 1 of the invention.

Next, description will be given below of embodiments, which are the specific examples of the mode for carrying out the invention, with reference to the accompanying drawings. However, the invention is not limited to the following embodiments.

In order to facilitate the understanding of the following description, in the drawings, the back and forth direction is expressed by the X-axis direction, the left and right direction is expressed by the Y-axis direction, and the vertical direction is expressed by the Z-axis direction; and, directions or sides shown by arrow marks X, −X, Y, −Y, Z, and −Z are regarded as a forward direction, a backward direction, a right direction, a left direction, an upward direction, and a downward direction, or a front side, a back side, a right side, a left side, an upper side, and a lower side, respectively.

Also, in the drawings, a mark, in which [.] is stated within [O], means an arrow going from the back of the sheet to the front thereof; and, a mark, in which [x] is stated within [O], means an arrow going from the front of the sheet to the back thereof.

And, in the following description that is given below with reference to the drawings, there are properly omitted the illustrations of other members than those necessary for explanation for easy understanding.

Embodiment 1

FIG. 1 is a perspective view of an image forming apparatus according to an embodiment 1 of the invention.

In FIG. 1, a copying machine U, which is used as the embodiment 1 of an image forming apparatus according to the invention, includes an automatic manuscript feed device U1 disposed in the upper end portion thereof, and an image forming apparatus main body U2 for supporting the automatic manuscript feed device U1. On the upper portion of the image forming apparatus main body U2, there is provided a sheet discharge tray TRh serving as an example of a medium discharge portion. Also, in the lower portion of the image forming apparatus main body U2, as examples of a medium container, there are removably mounted a plurality of sheet supply trays TR1~TR4 which are used to store therein a sheet serving as an example of a medium. On the front surface of the upper portion of the image forming apparatus main body U2, there is supported a front cover Ua serving as an example of a front surface opening and closing member.

Figure 2:
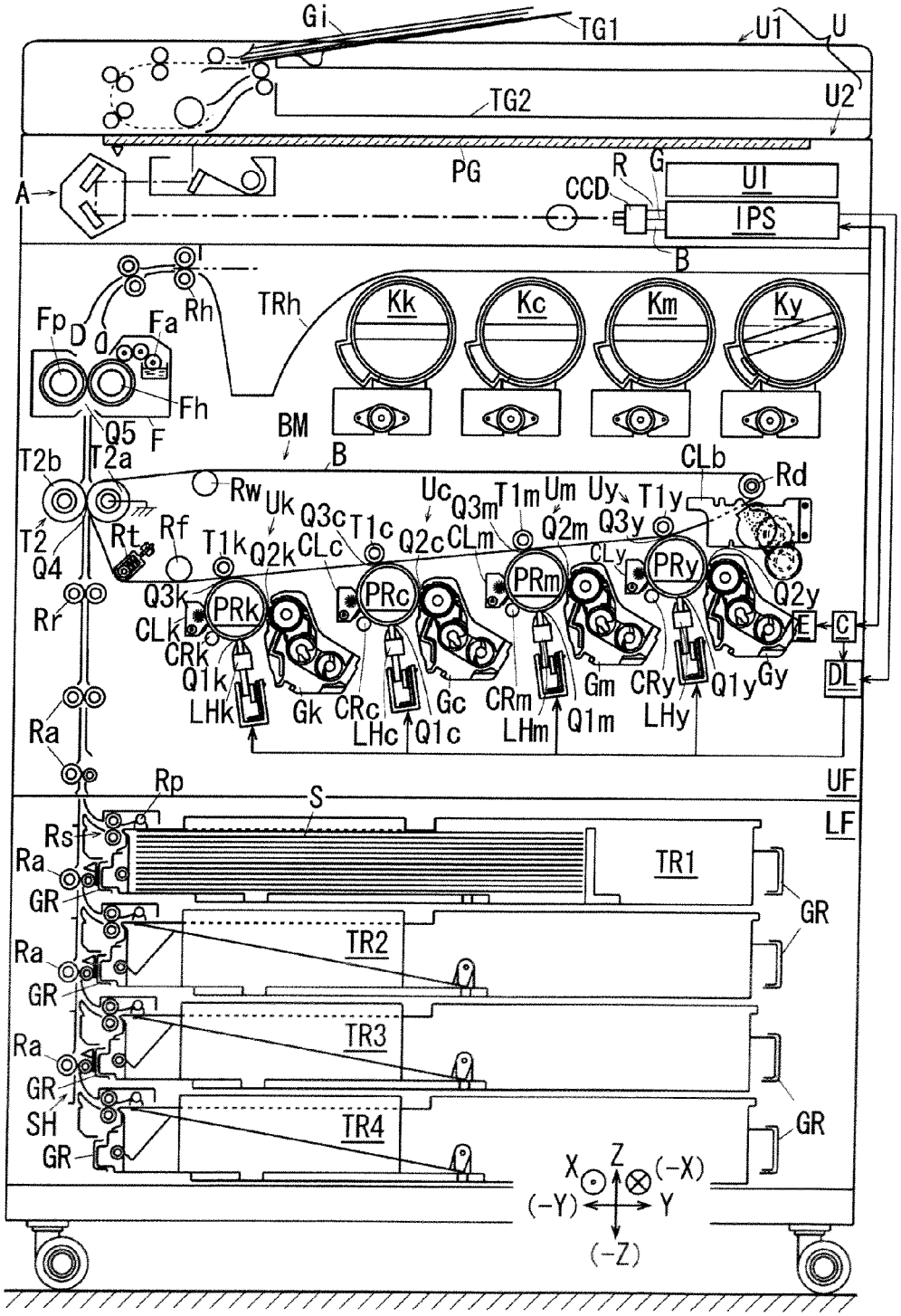
FIG. 2 is a general explanatory view of the image forming apparatus according to the embodiment 1 of the invention.

FIG. 2 is a general explanatory view of the image forming apparatus according to the embodiment 1 of the invention.

In FIG. 2, the automatic manuscript feed device U1 includes: a manuscript supply portion TG1 into which a plurality of manuscripts Gi to be copied are stored while they are superimposed on top of each other; and, a manuscript discharge portion TG2 from which there are discharged the manuscripts Gi that are supplied from the manuscript supply portion TG1 and fed while they are moving through a manuscript read portion set on a transparent manuscript read surface PG disposed in the upper end of the image forming apparatus main body U2.

The image forming apparatus main body U2 includes: an operation portion UI through which a user inputs and operates an operation instruct signal for starting an image forming operation or the like; an exposure optical system A; and, other elements.

A reflected light, which is reflected from a manuscript being fed on the manuscript read surface PG by the automatic manuscript feed device U1 or from a manuscript manually placed on the manuscript read surface PG, is converted through the exposure optical system A into electric signals, that is, a red R signal, a green G signal and a blue B signal by a solid state imaging device CCD.

An image information converting portion IPS converts the R, G and B electric signals, which are input from the solid state imaging device CCD, to image information on black K, yellow Y, magenta M and cyan C and stores therein the thus converted image information temporarily; and, at a given timing, it outputs the image information to a latent image forming device drive circuit DL as image information for formation of latent images.

Here, when the manuscript image is a single color image, that is, a so called a monochrome image, only the image information on black K is input to the latent image forming device drive circuit DL.

The latent image forming device drive circuit DL includes drive circuits (not shown) respectively for the respective colors Y, M, C and K; and, at a given timing, it outputs signals corresponding to the image information input therein to latent image forming devices LHy, LHm, LHc and LHk which are disposed for the respective colors.

Figure 3:
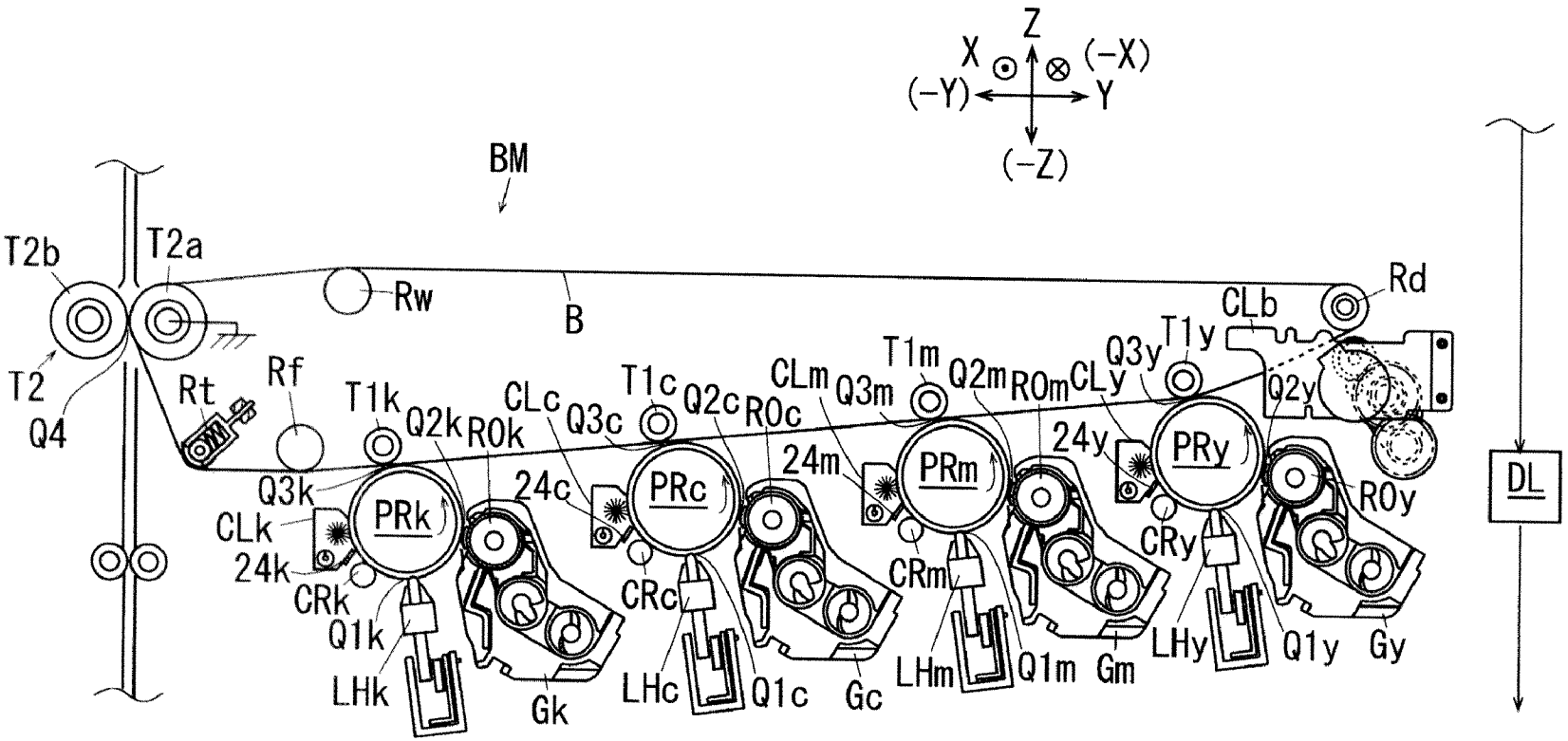
FIG. 3 is an enlarged explanatory view of the image forming apparatus according to the embodiment 1 of the invention.

FIG. 3 is an enlarged explanatory view of the main portions of an image forming apparatus according to the embodiment 1.

Visible image forming devices Uy, Um, Uc and Uk, which are disposed in the central portion of the above-mentioned image forming apparatus U in the gravitation direction thereof, are respectively devices that are used to form the respective visible images, that is, Y, M, C and K.

Latent image write lights Ly, Lm, Lc and Lk, which are radiated from the respective latent image write light sources of the latent image forming devices LHy~LHk, respectively enter their associated rotating image holders PRy, PRm, PRc and PRk. Here, in the embodiment 1, the latent image forming devices LHy~LHk are respectively made of a so called LED array.

The Y visible image forming device Uy includes a rotating image holder PRy, a charging device CRy, a latent image forming device LHy, a developing device Gy, a transfer device T1*y*, and an image holder cleaning device CLy. According to the embodiment 1, the image holder PRy, charging device CRy and image holder cleaning device CLy are structured as an image holder unit which can be removably mounted onto the image forming apparatus main body U2 integrally therewith.

The visible image forming devices Um, Uc and Uk are each structured similarly to the Y visible image forming device Uy.

In FIGS. 2 and 3, after the image holders PRy, PRm, PRc and PRk are electrically charged by their associated charging devices CRy, CRm, CRc and CRk, electrostatic latent images are formed at image write positions Q1*y*, Q1*m*, Q1*c* and Q1*k* on the surfaces of the image holders PRy, PRm, PRc and PRk by the latent image write lights Ly, Lm, Lc and Lk respectively. The electrostatic latent images on the surfaces of the image holders PRy, PRm, PRc and PRk are developed to toner images as an example of a visible image in developing areas Q2*y*, Q2*m*, Q2*c* and Q2*k* by image forming materials respectively held by developing rollers R0*y*, R0*m*, R0*c* and R0*k* which are used as the examples of the image forming material holders of the developing devices Gy, Gm, Gc and Gk.

The thus developed toner images are fed to primary transfer areas Q3*y*, Q3*m*, Q3*c* and Q3*k* which are in contact with an intermediate transfer belt B used as an example of an intermediate transfer member. To primary transfer devices T1*y*, T1*m*, T1*c* and T1*k* which are respectively disposed in the primary transfer areas Q3*y*, Q3*m*, Q3*c* and Q3*k* on the back surface side of the intermediate transfer belt B, from a power supply circuit E to be controlled by a control portion C, at a given timing, there is applied a primary transfer voltage the polarity of which is reverse to the charged polarity of the toner.

In addition, the image forming material is not limited to a developer, but it may be any material capable of forming the image. Further, the image forming material is not limited to a powder material, but it may be a liquid material such as an ink.

The toner images on the image holders PRy~PRk are primarily transferred to an intermediate transfer belt B by the primary transfer devices T1*y*, T1*m*, T1*c* and T1*k*, respectively. Remaining materials and sticking materials on the surfaces of the image holders PRy, PRm, PRc and PRk after execution of the primary transfer are cleaned by image holder cleaning devices CLy, CLm, CLc and CLk, respectively. The thus cleaned surfaces of the image holders PRy, PRm, PRc and PRk are electrically charged again by charging devices CRy, CRm, CRc and CRk, respectively.

Upwardly of the image holders PRy~PRk, there is disposed a belt module BM used as an example of an intermediate transfer device which can be moved vertically and can be pulled out forwardly. The belt module BM includes the intermediate transfer belt B, a belt drive roller Rd used as an example of an intermediate transfer body drive member, a tension roller Rt used as an example of an intermediate transfer body carrying member, a walking roller Rw used as an example of a meandering preventive member, an idler roller Rf used as an example of a driven member, a backup roller T2*a* used as an example of a secondary transfer area opposing member, and the above-mentioned primary transfer devices T1*y*, T1*m*, T1*c*, T1*k*. And, the intermediate transfer belt B is supported in a rotationally movable manner by belt support rollers Rd, Rt, Rw, Rf and T2*a* which are used as examples of intermediate transfer body support members and are made of the above-mentioned rollers Rd, Rt, Rw, Rf and T2*a*, respectively.

Opposed to the surface of the intermediate transfer belt B in contact with the backup roller T2*a*, there is disposed a secondary transfer roller T2*b* used as an example of a secondary transfer member; and, the above-mentioned rollers T2*a* and T2*b* cooperate together in constituting a secondary transfer device T2. Also, in an area which exists opposed to the secondary transfer device T2 and intermediate transfer belt B, there is formed a secondary transfer area Q4.

Monochrome or multi-color toner images, which are transferred sequentially and superimposedly onto the intermediate transfer belt B in the primary transfer areas Q3*y*, Q3*m*, Q3*c* and Q3*k* by the primary transfer devices T1*y*, T1*m*, T1*c* and T1*k*, are fed to the secondary transfer area Q4.

Downwardly of the respective visible image forming devices Uy~Uk, there are provided a pair of right and left guide rails GR used as examples of guide members in four stages; and, on the guide rails GR, there are supported sheet supply trays TR1~TR4 in such a manner that they can be moved in the back and forth direction. Sheets S, which are stored in the sheet supply trays TR1~TR4, are taken out by a pickup roller Rp used as an example of a medium take-out member and are then separated one by one from each other by a handling roller Rs used as an example of a medium handling member. And, the sheets S are fed by a plurality of feed rollers Ra as examples of medium feed members along a sheet feed passage SH as an example of a medium feed passage and are sent to a regi-roller (a registration roller) Rr used as an example of a transfer area feed timing registration member which is disposed on the upstream side in the sheet feed direction of the secondary transfer area Q4. The sheet feed passage SH, sheet feed roller Ra, regi-roller Rr and the like cooperate together in constituting a sheet feed device SH+Ra+Rf.

The regi-roller Rr, at a timing when the toner images formed on the intermediate transfer belt B are fed to the secondary transfer area Q4, feeds the sheets S to the secondary transfer area Q4. When the sheets S pass through the secondary transfer area Q, the backup roller T2*a* is grounded and, to the secondary transfer device T2*b*, from an power supply circuit E which is controlled by the control portion C, there is applied a secondary transfer voltage having a reversed polarity to the charged polarity of the toner. At the then time, the toner images on the intermediate transfer belt B are transferred to the sheets S by the secondary transfer device T2 respectively.

After execution of the secondary transfer, the intermediate transfer belt B is cleaned by a belt cleaner CLb used as an example of an intermediate transfer body cleaning device.

The sheets S, on which the toner images have been transferred secondarily, are fed to a fixing area Q5 which is a pressure contact area between a heating roller Fh used as an example of the heating fixing member of a fixing device F and a pressurizing roller Fp serving as an example of the pressurizing fixing member of the fixing device F; and, the sheets S are heated and fixed when they pass through the fixing area Q5. The thus heated and fixed sheets S are discharged from a discharge roller Rh used as an example of a medium discharge member to a sheet discharge tray TRh used as an example of a medium discharge portion.

Here, on the surface of the heating roller Fh, by a mold release agent apply device Fa, there is applied a mold release agent for enhancing the releasing property of the sheets S from the heating roller.

Upwardly of the belt module BM, there are arranged toner cartridges Ky, Km, Kc and Kk which are the examples of storage containers respectively for storing a yellow Y image forming material, a magenta M image forming material, a cyan C image forming material and a black K image forming material. The image forming materials stored in their associated toner cartridges Ky, Km, Kc, and Kk, according to the consumption of the Gy, Gm, Gc and Gk image forming materials, are supplied from an image forming material supply passage (not shown) to the developing devices Gy, Gm, Gc and Gk respectively. Here, in the embodiment 1, the above-mentioned image forming material is made of a binary image forming material which includes a magnetic carrier and a toner with an external agent applied thereto.

In FIG. 2, the image forming apparatus U includes an upper frame body UF and a lower frame body LF; and, on the upper frame body UF, there are supported the visible image forming devices Uy~Uk and members disposed upwardly of the visible image forming devices Uy~Uk, that is, the belt module BM and the like.

Also, on the lower frame body LF, there are supported the guide rails GR respectively for supporting the sheet supply trays TR1~TR4 and the sheet supply members for supplying the sheets from the sheet supply trays TR1~TR3, that is, the pickup roller Rp, handling roller Rs, sheet feed roller Ra and the like.

(Description of Toner Cartridge Mounting and Removing Structure)

Figure 4:
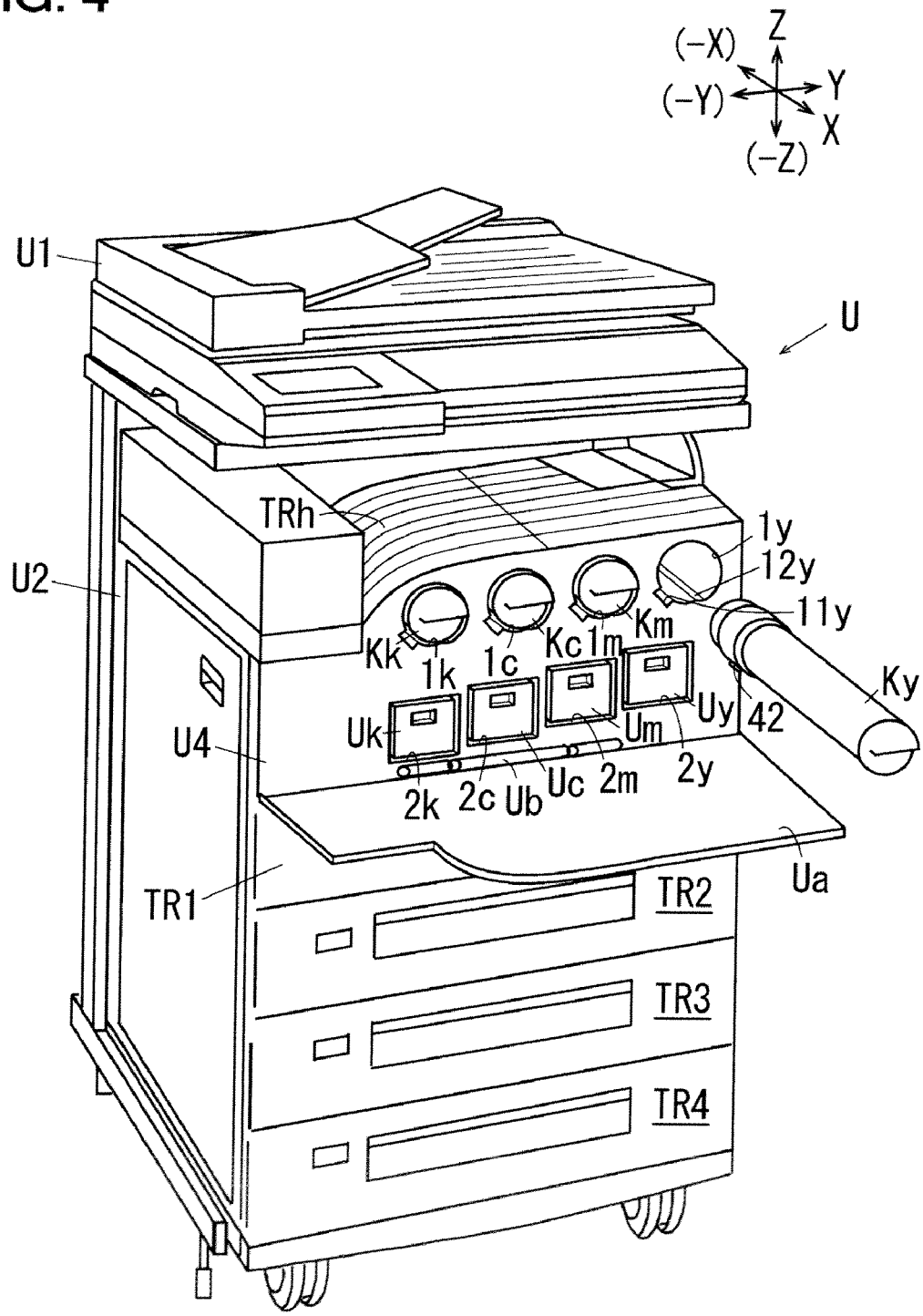
FIG. 4 is an explanatory view of the image forming apparatus according to the embodiment 1 of the invention, showing a state where the front cover thereof is opened and a yellow toner cartridge is removed therefrom.

FIG. 4 is an explanatory view of the image forming apparatus according to the embodiment 1, showing a state where the front cover thereof is opened and a yellow toner cartridge is removed therefrom.

In FIGS. 1 and 4, the front cover Ua of the copying machine U is rotatably supported on the image forming apparatus main body U1 by a joint Ub. Therefore, the front cover Ua is rotatably supported between a normal position, which is shown in FIG. 1 and where the front cover Ua is held during execution of an image forming operation and in the wait time, and a maintenance operation position, which is shown in FIG. 4 and where the maintenance operation such as an operation to replace the toner cartridges Ky~Kk and visible image forming devices Uy, Um, Uc and Uk and other similar operations are carried out.

In FIG. 4, inside the front cover Ua, there is supported a front panel U4 which is used as an example of the front surface member of the image forming apparatus main body U1. In the front panel U4, as an example of a supply vessel mounting portion, there are formed cylindrical-shaped toner cartridge mounting portions 1*y*, 1*m*, 1*c* and 1*k* with respect to which the cylindrical-shaped color toner cartridges Ky~Kk can be mounted and removed. On the front panel U4, as an example of a visible image forming device mounting portion, there are formed process cartridge mounting portions 2*y*, 2*m*, 2*c* and 2*k*.

Figure 5:
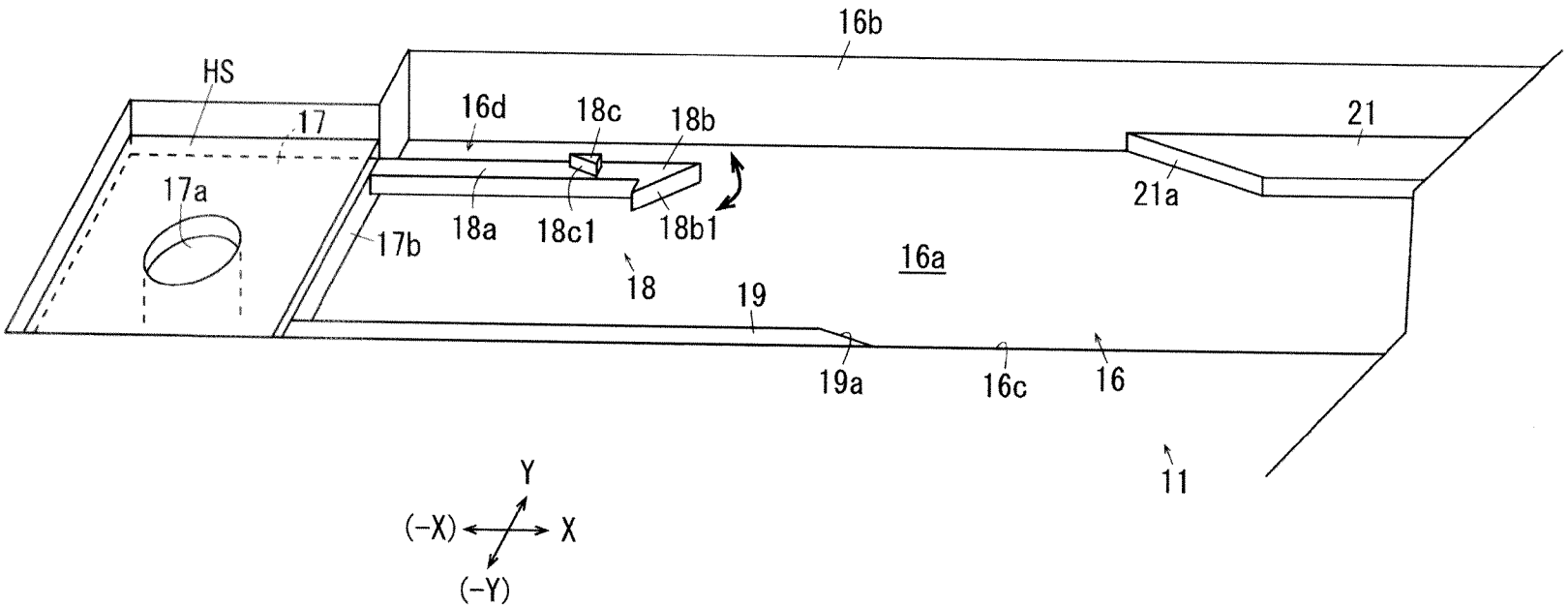
FIG. 5 is an explanatory perspective view of the main portions of a flow-out opening guide portion of the image forming apparatus according to an embodiment 1 of the invention.

FIG. 5 is an explanatory perspective view of the main portions of a flow-out opening guide portion according to the embodiment 1.

Here, since the toner cartridge mounting portions 1*k*~1*y* for Y, M, C and K are structured similarly to each other, in the following description, the toner cartridge mounting portion 1*y* for yellow Y will be described in detail, while there is omitted the detailed description of the other toner cartridge mounting portions 1*m*, 1*c* and 1*k*.

In FIG. 4, the toner cartridge mounting portion 1*y* includes: a groove-shaped flow-out opening guide portion 11*y* formed in the downward left portion thereof and extending in the back and forth direction; and, a stage-shaped container guide portion 12*y* formed in the upward right portion thereof and extending in the back and forth direction.

In FIG. 5, the flow-out opening guide portion 11*y* includes a main guide passage 16 extending in the back and forth direction which is the cartridge mounting and removing direction. The main guide passage 16 includes a bottom wall 16*a*, a right wall 16*b* and a left wall 16*c* which respectively extend in the back and forth direction. On the rear end portion of the main guide passage 16, there is provided a flow-in opening portion 17 which is formed in the image forming apparatus main body U1 and into which image forming materials from the toner cartridges Ky~Kk are allowed to flow. The flow-in opening portion 17 is formed to be one stage higher than the bottom wall 16*a* of the main guide passage 16. On the outer surface of the flow-in opening portion 17, as an example of a main body side seal member, there is supported a main body side seal member HS which is made of an elastic material.

In FIG. 5, on the front right portion of the front end face 17*b* of the flow-in opening portion 17, there is provided a shutter hold member 18 which projects forwardly. The shutter hold member 18 includes an elastically deformable arm portion 18*a* used as an example of a hold member arm portion, while the height of the upper end face of the arm portion 18*a* is set so as to correspond to the stage difference of the flow-in opening portion 17. On the right of the arm portion 18*a*, there is formed an elastically deformation allowable clearance 16*d* which intervenes between the right wall 16*b* of the main guide passage 16 and the arm portion 18*a*, while the arm portion 18*a* is supported such that it can be elastically deformed in the right and left direction.

In the front end of the arm portion 18*a*, there is formed a hold pawl portion 18*b* which projects in the left direction. On the front side of the hold pawl portion 18*b*, there is formed a mounting time elastically deformable guide surface 18*b*1 which inclines in the left direction as it goes in the backward direction.

In the rear of the hold pawl portion 18*b*, there is provided a hold removing contacted portion 18*c* which projects upwardly of the arm portion 18*a*; and in the hold removing contacted portion 18*c*, there is formed a removing contact surface 18*c*1 which is formed in a right triangle shape and inclines in the left direction as it goes forwardly.

On the front left side of the front end face of the flow-in opening portion 17, as an example of a mounting time open-close member guide portion, there is formed a left side guide portion 19 which extends forwardly. The left side guide portion 19 is formed to the height of the flow-in opening portion 17 and, in the front end portion of the left side guide portion 19, there is formed a mounting time shutter guide surface 19*a* which inclines in the left direction as it goes forwardly.

In the front portion of the main guide passage 16, as an example of a removing time open-close member guide portion, there is formed a right side guide portion 21 which extends in the back and forth direction. The right side guide portion 21 is formed to the height of the flow-in opening portion 17 and left side guide portion 19 and, in the rear end portion of the right side guide portion 21, there is formed a removing time shutter guide surface 21*a* which inclines in the right direction as it goes backwardly. Here, the left side guide portion 19 and right side guide portion 21 are formed in such a manner that the distance between the front end of the mounting time shutter guide surface 19*a* and the rear end of the removing time shutter guide surface 19 is larger than the length of the shutter in the back and forth direction thereof (which will be discussed later).

(Description of Toner Cartridge)

Figure 6:
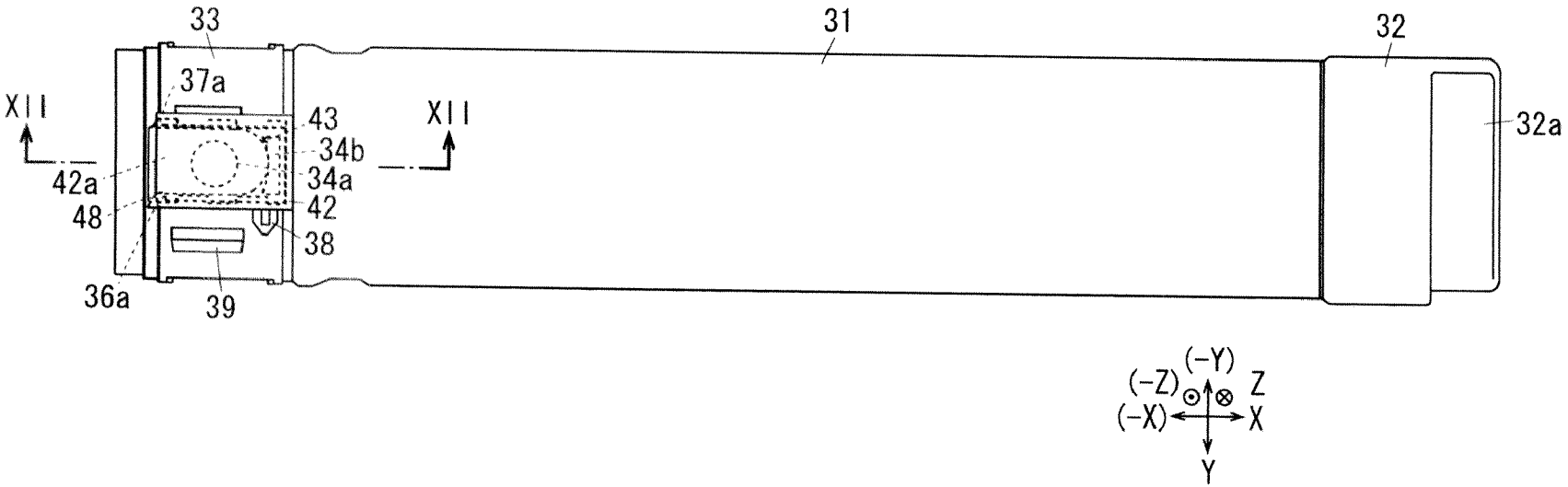
FIG. 6 is a view of a toner cartridge used as an example of a storage container according to the embodiment 1 of the invention, when it is viewed from the flow-out opening side.

FIG. 6 is a view of a toner cartridge according to the embodiment 1 of the storage container of the invention, when it is viewed from the flow-out opening side thereof.

Figure 7:
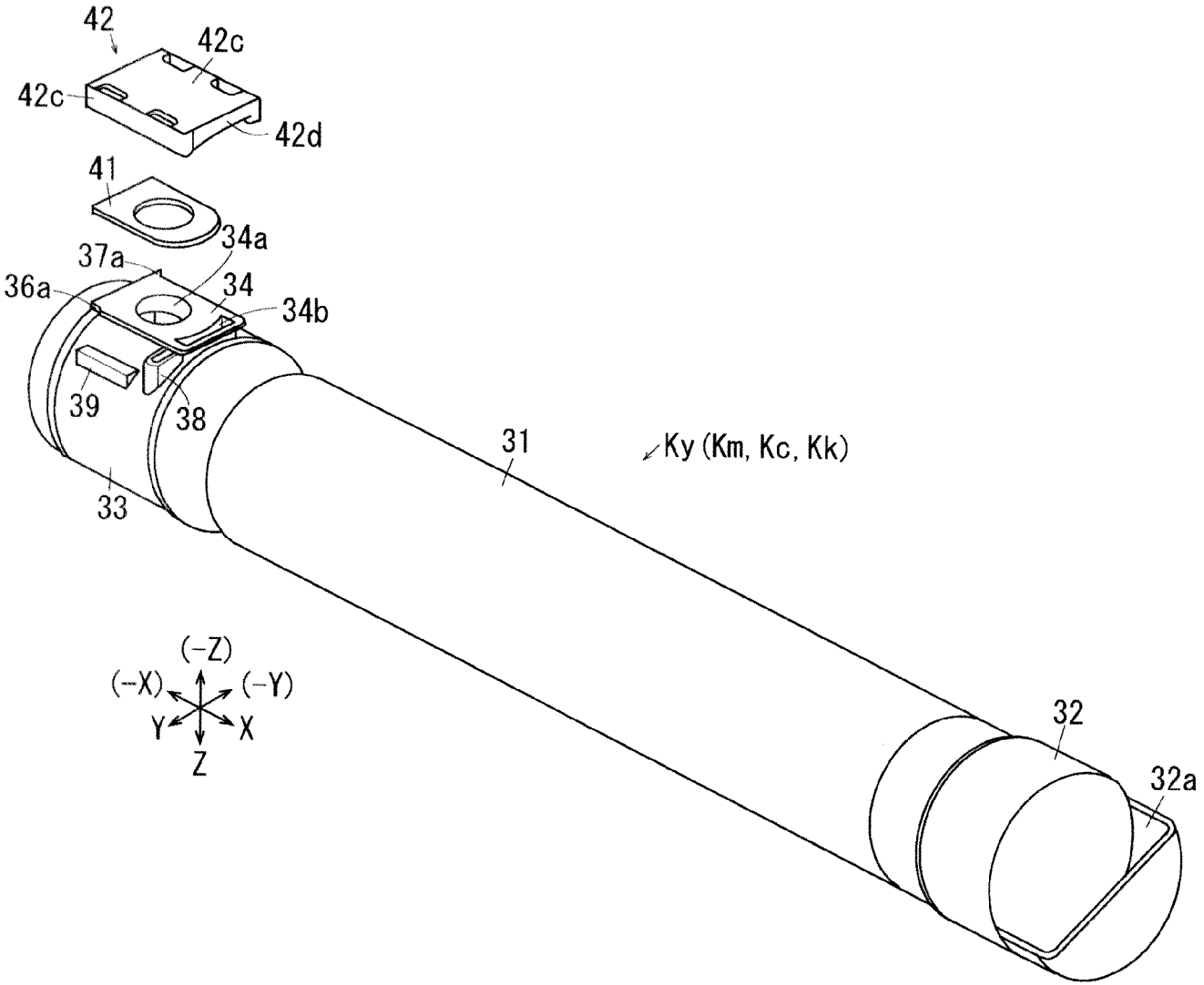
FIG. 7 is an explanatory exploded view of the flow-out opening portion of the toner cartridge according to the embodiment 1 of the invention.

FIG. 7 is an explanatory exploded view of the flow-out opening portion of a toner cartridge according to the embodiment 1.

Here, since the toner cartridges Ky~Kk for the respective colors are structured similarly to each other, in the following description, the toner cartridge Ky for yellow Y will be description in detail, while there is omitted the detained description of the other remaining toner cartridges Km, Kc and Kk.

In FIGS. 4, 6 and 7, the toner cartridge Ky, as an example of a storage container main body, is formed to have a substantially cylindrical shape which extends in the back and forth direction; and, the toner cartridge Ky includes a cartridge main body 31 for storing an image forming material therein. On the front end portion of the cartridge main body 31, there is supported a container front end member 32; and, in the container front end member 32, there is formed a grip portion 32*a* which is used by a user when replacing the toner cartridge Ky.

In FIGS. 4, 6 and 7, on the rear end portion of the cartridge main body 31, there is supported a container rear end member 33. The container rear end member 33 is structured in the following manner. That is, on the rear end of the container rear end member 33, there is rotatably supported a conventionally known driven coupling (not shown) as an example of a driven transmission member. Specifically, when the image forming apparatus main body U1 is mounted, the driven coupling is allowed to bite into a drive coupling disposed in the rear end of a toner cartridge mounting portion to receive a driving force from the drive coupling, so that the driven coupling rotates a conventionally known image forming material feed member (not shown) provided within the cartridge main body 31 to thereby feed the image forming material backwardly in the axial direction. Here, the drive coupling, driven coupling and image forming material feed member are disclosed, for example, in the Japanese patent publications 2004-252184, 2005-134452, 2005-181515 and the like. That is, since they are conventionally known, there is omitted here the illustration and detailed description thereof.

Figure 8:
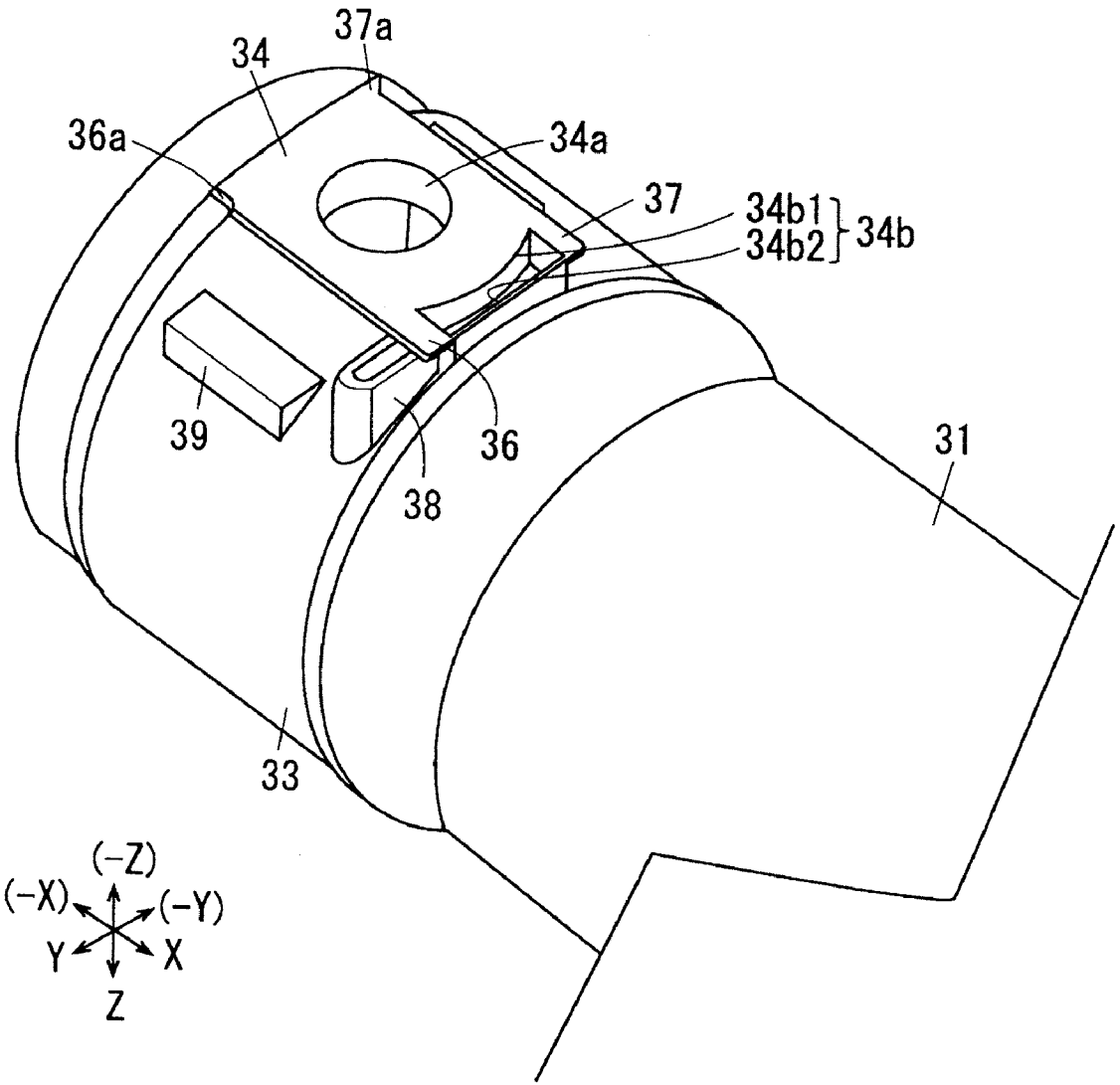
FIG. 8 is an enlarged view of the main portions of the flow-out opening portion of the toner cartridge according to an embodiment 1 of the invention.

FIG. 8 is an enlarged view of the main portions of the flow-out opening portion of a toner cartridge according to the embodiment 1.

Figure 9:
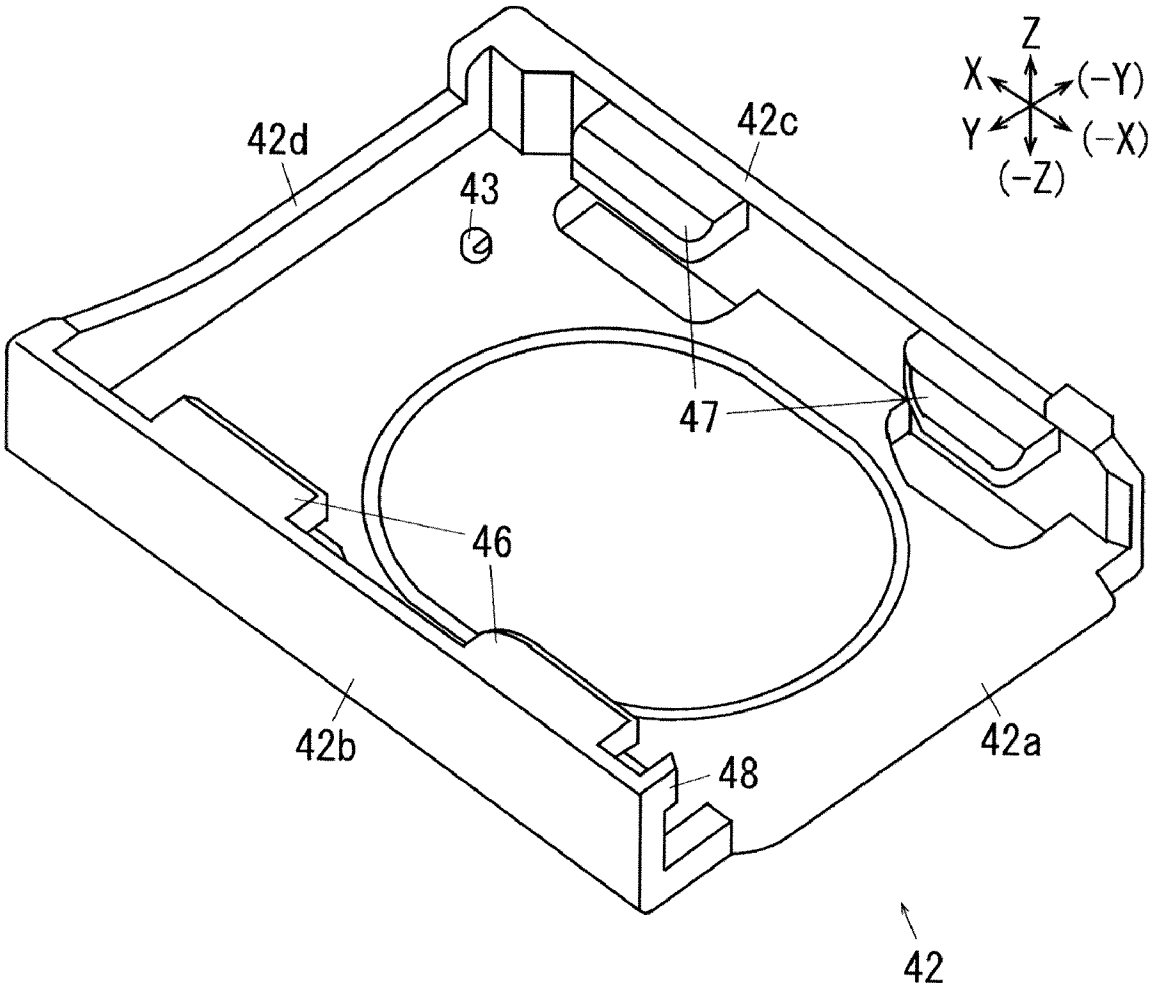
FIG. 9 is an explanatory perspective view of a shutter according to the embodiment 1 used as an example of an open-close member.

FIG. 9 is an explanatory perspective view of a shutter according to the embodiment 1 which is used as an example of an open-close member.

Figure 10A:
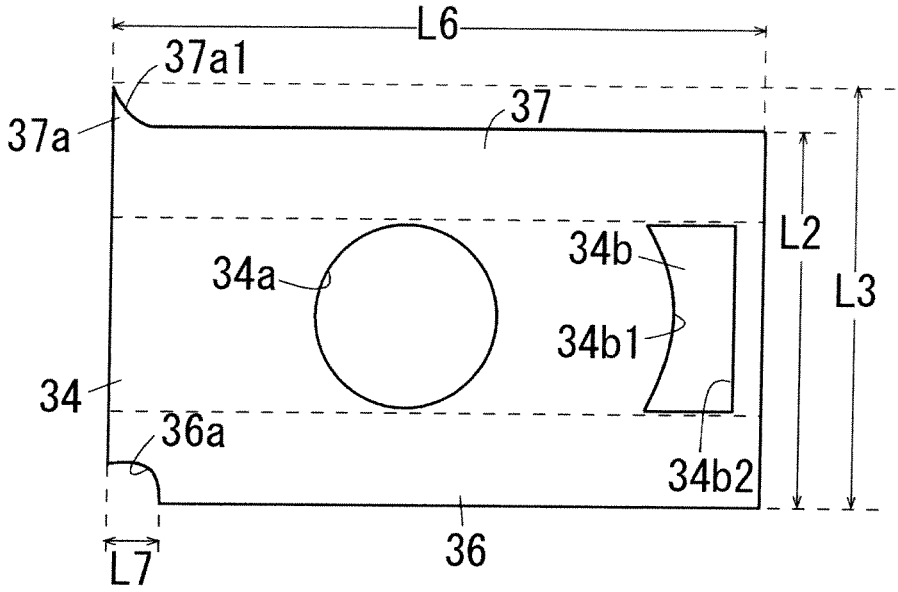
FIG. 10A is an explanatory view of the flow-out opening forming portion and FIG. 10B is an explanatory view of the shutter.
Figure 10B:
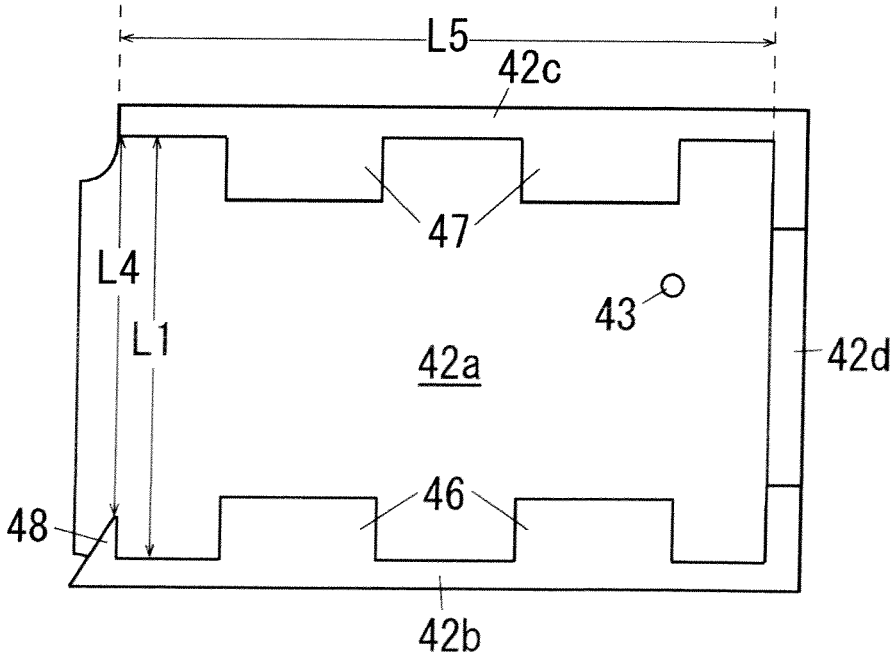

FIG. 10 explains the length relationship between a flow-out opening forming portion and a shutter: Specifically, FIG. 10A is an explanatory view of the flow-out opening forming portion; and, FIG. 10B is an explanatory view of the shutter.

In FIGS. 4, 6~10, in the container rear end member 33, there is formed a flow-out opening forming portion 34 which projects outwardly in the diameter direction. Here, the flow-out opening forming portion 34 is formed such that it extends in the diameter direction inclined in the left downward direction with respect to the downward direction of the gravitational force. In the flow-out opening forming portion 34, there is formed a flow-out opening 34*a* which is formed so as to correspond to the flow-in opening 17*a* of the image forming apparatus U and also which allows the image forming material fed by the image forming material fed member to flow into the flow-in opening 17*a*. The flow-out opening 34*a* according to the embodiment 1 is formed in a circular hole shape. In front of the flow-out opening 34*a*, there is formed an open-close movement restricting recess portion 34*b* which is formed in a recess shape inwardly in the diameter direction as an example of an open-close movement restricting portion. The open-close movement restricting recess portion 34*b* includes an arc-shaped rear end face 34*b*1 having a concentrical circle with the circular-hole-shaped flow-out opening 34*a*, and a linear-shaped front end face 34*b*2 which is disposed spaced from the arc-shaped rear end face 34*b*1 and is parallel to the front end face of the flow-out opening forming portion 34.

In FIG. 8, on the outer end of the flow-out opening forming portion 34 in the diameter direction, as an example of an open-close member support member, there are provided shutter support portions 36 and 37 which respectively project more in the right and left direction than the flow-out opening forming portion 34 and extend in the back and forth direction. In the rear end portion of the right shutter support portion 36, as an example of a mount-remove direction movement restricting portion, there is formed a notch-shaped shutter movement restricting recess portion 36*a*. In the rear end portion of the left shutter support portion 37, as an example of a mount-remove direction movement guide portion, there is provided a shutter guide projection portion 37*a* which projects outwardly, that is, in the left direction. The shutter guide projection portion 37*a* has a closing-time guide surface 37*a*1 which inclines in the left direction as it goes in the backward direction.

In FIGS. 6~8, the container rear end member 33 includes, on the right front portion of the flow-out opening forming portion 34, a removing projection 38 extending in the right direction as an example of a removing contact portion. The removing projection 38 is formed such that it can be contacted with the removing contact surface 18*c*1 of the removing-time contacted portion 18.

On the right of the flow-out opening forming portion 34, as an example of a container guided portion, there is provided a guided portion 39 which projects outwardly from the outer peripheral surface of the container rear end member 33. The guided portion 39 is guided by the container guide portion 12 of the image forming apparatus main body U1 and is thereby guided in the back and forth direction when the toner cartridge Ky is mounted or removed.

In FIG. 8, on the outer surface of the flow-out opening forming portion 34, there is fixed and supported a seal member 41 made of an elastic member as an example of a seal member. The seal member 41 according to the embodiment 1 is disposed in the periphery of the flow-out opening 34*a* and is also supported such that it does not cover the open-close movement restricting recess portion 34*b*.

In FIGS. 6~9, on the flow-out opening forming portion 34, there is supported a shutter 42 as an example of a shutter. In FIG. 9, the shutter 42 includes a plate-shaped shutter main body 42*a*, two left and right side walls 42*b* and 42*c* respectively extending from the two left and right ends of the shutter main body 42*a* toward the flow-out opening forming portion 34, and a front end wall 42*d*. According to the embodiment 1, the thickness of the shutter main body 42*a* is set substantially the same as the height of the flow-in opening portion 17 of the image forming apparatus main body U1. On the left portion of the front side of the shutter main body 42*a*, as an example of a restricting portion, there is provided a movement restricting projection 43 which is formed so as to project toward the flow-out opening forming portion 34 in correspondence to the open-close movement restricting recess portion 34*b*.

In the leading ends of the two right and left side walls 42*b* and 42*c*, there are formed two pairs of right and left supported portions 46 and 47 which respectively project inwardly. Therefore, since the supported portions 46 and 47 are supported by the shutter support portions 36 and 37 respectively, the shutter 42 can be supported such that it can be moved along the cartridge mounting and removing direction. Here, at the then time, the distances between the inner surfaces of the shutter main body 42*a* and supported portions 46, 47 are set slightly smaller than the thicknesses of the shutter support portions 36, 37 and seal member 41. Owing to this, the seal member 41 is held in a pressed state, the seal member 41 is elastically deformed, and the seal member 41 and shutter main body 42*a* are closely contacted and sealed up together to seal up the flow-out opening 34*a*, thereby being able to prevent the leakage of the toner. Here, owing to the elastic restoration force of the seal member 41, there is increased a friction force between the shutter 42 and seal member 41, which not only can reduce the possibility that the shutter 42 can be opened and closed in error but also, when mounting the toner cartridge Ky onto the image forming apparatus main body U1, can provide a user with a good mounting feeling.

Also, on the rear end portion of the right side wail 42*b* of the shutter 42, as an example of a mount-remove direction movement restricted portion, there is provided a shutter movement restricting pawl portion 48 which is disposed in correspondence to the shutter movement restricting recess portion 36*a* and also which projects inwardly.

In FIG. 10, according to the flow-out opening forming portion 34 and shutter 42 of the embodiment 1, the side wall distance L1 between the respective inner surfaces of the two right and left side walls 42*b* and 42*c* of the shutter 42 is set not only larger than the width L2 between the respective support portions of the shutter support portions 36 and 37, but also substantially the same as the flow-out opening forming portion maximum width L3 between the outer end of the shutter guiding projection portion 37*a* and the outer end of the right shutter support portion 36. Also, the pawl inner wall distance L4 between the inner end of the shutter movement restricting pawl portion 48 and the left side wall 42*c* of the shutter 42 is set larger than the support portion distance L2 and smaller than the maximum width L3. Further, the shutter mounting direction length L5 between the rear ends of the right and left side walls 42*b* and 42*c* of the shutter 42 and the inner surface of the front end wall 42*d* is set larger than the mounting direction length 16 of the flow-out opening forming member 37.

Figure 11A:
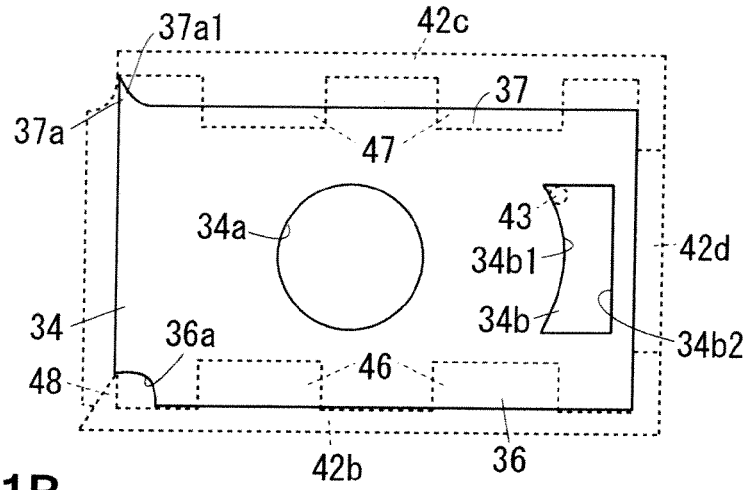
FIG. 11A is an explanatory view of the shutter, showing a state where the shutter is moved to the closing position thereof.
Figure 11B:
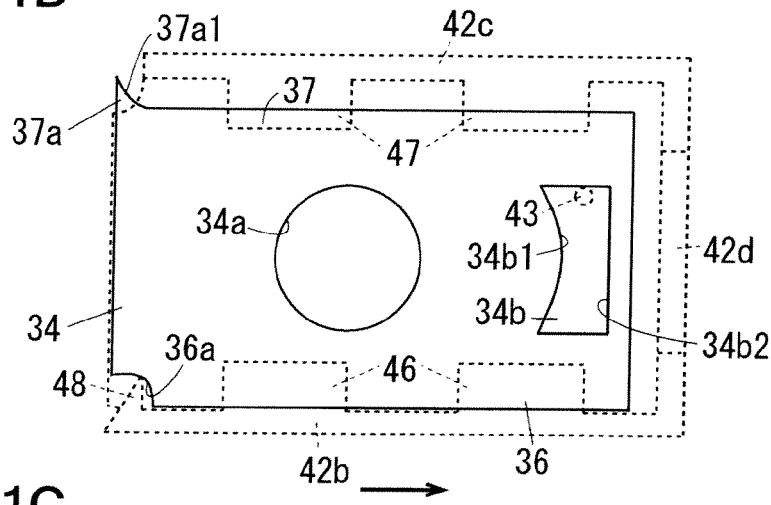
FIG. 11B is an explanatory view of the shutter, showing a state where the shutter is moved to the movement restricting position thereof.
Figure 11C:
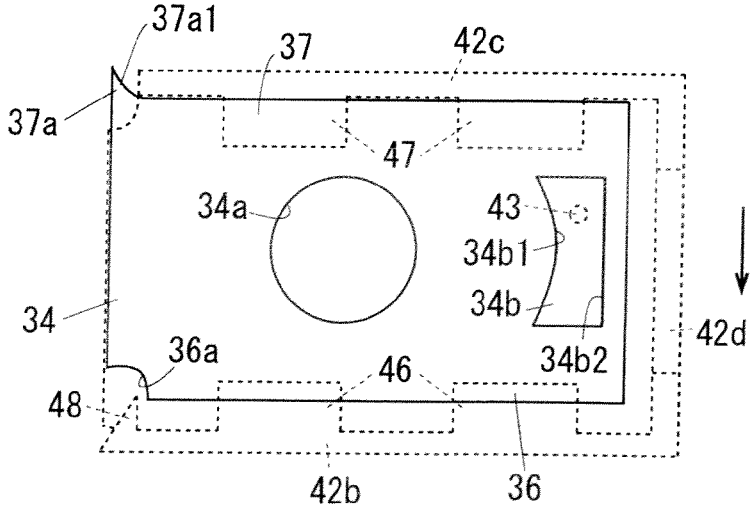
FIG. 11C is an explanatory view of the shutter, showing a state where the shutter is moved to the opening start position thereof.

Now, FIG. 11 explains the position relationship of the shutter 42 to the flow-out opening forming portion 34. Specifically, FIG. 11A is an explanatory view of a state where the shutter 42 is moved to its closed position, FIG. 11*b* is an explanatory view or a state where the shutter 42 is moved to its movement restricting position, and FIG. 11C is an explanatory view of a state where the shutter 42 is moved to its opening start position.

Therefore, as shown in FIG. 11A, in a state where the shutter 42 is moved to the closed position, the inner surfaces of the two side walls 42*b* and 42*c* of the shutter 42 are respectively supported by the outer end of the shutter guiding projection portion 37*a* and the outer edge of the right shutter support portion 36 in such a manner that they are prevented from moving in the shutter width direction perpendicular to the cartridge mounting and removing direction.

And, when the shutter 42 is moved from the closed position shown in FIG. 11A in the cartridge mounting and removing direction, that is, only in the shutter moving direction and is moved to the movement restricting portion shown in FIG. 11B, the shutter movement restricting pawl portion 48 is caught by the shutter movement restricting recess portion 36*a* and is thereby prevented from moving in the shutter moving direction. That is, even when the toner cartridge Ky is handled in the wrong way and thus the shutter 42 is contacted with a desk or the like to thereby apply an external force to the shutter 42 for moving the shutter 42, the shutter 42 is prevented against movement. Specifically, even when there is applied such force that is going to move the shutter 42 in the moving direction thereof, the movement of the shutter 42 is restricted by the shutter movement restricting pawl portion 48; and, even when there is applied such force that is going to move the shutter 42 in the shutter width direction, because the shutter 42 is prevented against movement at the closed position thereof, the movement of the shutter 42 is restricted. At the then time, since the dimension relationship is set such that the side wall distance L1>the support portion width L2, the shutter 42 can be moved in a direction perpendicular to the cartridge mounting and removing direction. Here, since the external force is often a one-axis direction force, after the shutter 42 is moved in the shutter moving direction, actually, there is raised almost no possibility that the force in the shutter width direction can act on the shutter 42, thereby reducing the possibility that the shutter 42 can be moved by mistake to its opening position.

When the shutter 42 is moved in the shutter width direction from the movement restricting position shown in FIG. 11B, the shutter 42 is moved to an opening start position shown in FIG. 11C. At the then time, since it is set such that the support portion width L2<the pawl inner wall distance L4<the maximum width L3, the shutter movement restricting pawl portion 48 is not caught by the shutter movement restricting recess portion 36*a* but the shutter 42 is held in such a state that it can be moved along the shutter moving direction.

Figure 12A:
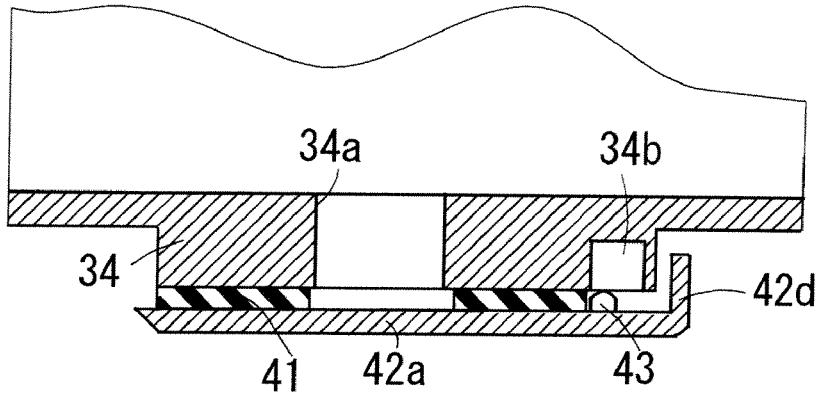
FIG. 12A is a section view taken along the XII-XII lines shown in FIG. 6, showing a state where the shutter is moved to the closing position; and, FIG. 12B is a section view taken along the XII-XII line shown in FIG. 6, showing a state where the shutter, at the closed position, receives a force for pressing the shutter from externally.
Figure 12B:
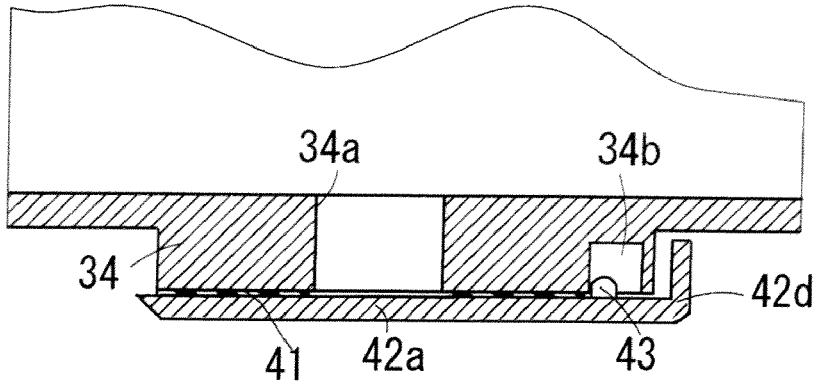
FIG. 12 is an explanatory section view of the main portions of the shutter according to the embodiment 1, specifically.

Now, FIG. 12 is an explanatory section view of the main portions of the shutter according to the embodiment 1. Specifically, FIG. 12A is a section view taken along the XII-XII lines shown in FIG. 6, showing a state where the shutter is moved to the closing position; and, FIG. 12B is a section view taken along the XII-XII lines shown in FIG. 6, showing a state where a pressing force is applied to the shutter from externally at the closing position of the shutter.

In FIGS. 10 and 11, the lengths of the movement restricting projection 43 and open-close movement restricting recess 34*b* are set such that, even when the shutter 42 is moved by a recess portion length L7 with respect to the length recess portion length L7 of the shutter movement restricting recess portion 36*a* along the cartridge mounting and removing direction, the movement restricting projection 43 can be contacted with the inner surface of the open-close movement restricting recess portion 34*b*. Therefore, in FIG. 12, in a state where no external force is acting on the shutter 42 at the closing position of the shutter 42, as shown in FIG. 12A, there is provided a state where the movement restricting projection 43 is not fitted into the open-close movement restricting recess portion 34*b*, that is, a state where the open-close movement restricting recess portion 34*b* is not overlapped with the leading end position of the movement restricting projection 43 along the moving direction of the shutter 42.

And, when the shutter 42 receives a pressing force from outwardly in the toner flow-out direction, if the seal member 41 is elastically deformed, the state shown in FIG. 12A is changed to the state shown in FIG. 12B, thereby providing a state where the movement restricting projection 43 is fitted into the open-close movement restricting recess portion 34*b*, that is, a state where the open-close movement restricting recess portion 34*b* is overlapped with the leading end position of the movement restrict mg projection 43 along the moving direction of the shutter 42. In this state, the fitting engagement between the movement restricting projection 43 and open-close movement restricting recess portion 34*b* restricts the movement of the shutter 42.

Figure 13A:
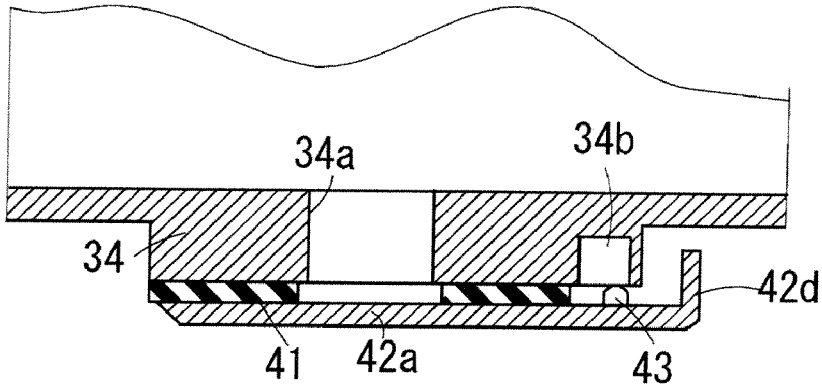
FIG. 13A is a section view corresponding to FIG. 12A, showing a state where the shutter is moved to the movement restricting position or to the opening start position; and, FIG. 13B is a section view corresponding to FIG. 12B, showing a state where the shutter is moved to the movement restricting position or to the opening start position.
Figure 13B:
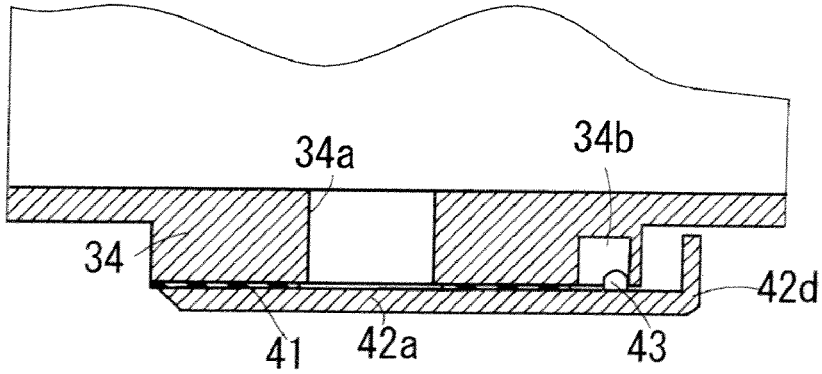
FIG. 13 is an explanatory section view of the main portions of the shutter according to the embodiment 1, specifically.

Now, FIG. 13 is an explanatory section view of the main portions of the shutter according to the embodiment 1. Specifically, FIG. 13A is a section view corresponding to FIG. 12A, in a state where the shutter is moved to the movement restricting position or the opening start position; and, FIG. 13B is a section view corresponding to FIG. 12B, in a state where the shutter is moved to the movement restricting position or the opening start position.

Also, in FIG. 13, when, in a state where the shutter 42 is moved to the movement restricting position or the opening start position, the shutter 42 receives a pressing force from externally in the toner flow-out direction, if the seal member 41 is elastically deformed, the state shown in FIG. 13A is changed to the state shown in FIG. 13B; and, in this state as well, there is provided a state where the movement restricting projection 43 is fitted into the open-close movement restricting recess portion 34*b*. Therefore, in this state as well, similarly to the above, the movement of the shutter 42 is restricted.

(Description of Mounting and Removing Operation of Toner Cartridge)

(Mounting Operation)

Figure 14:
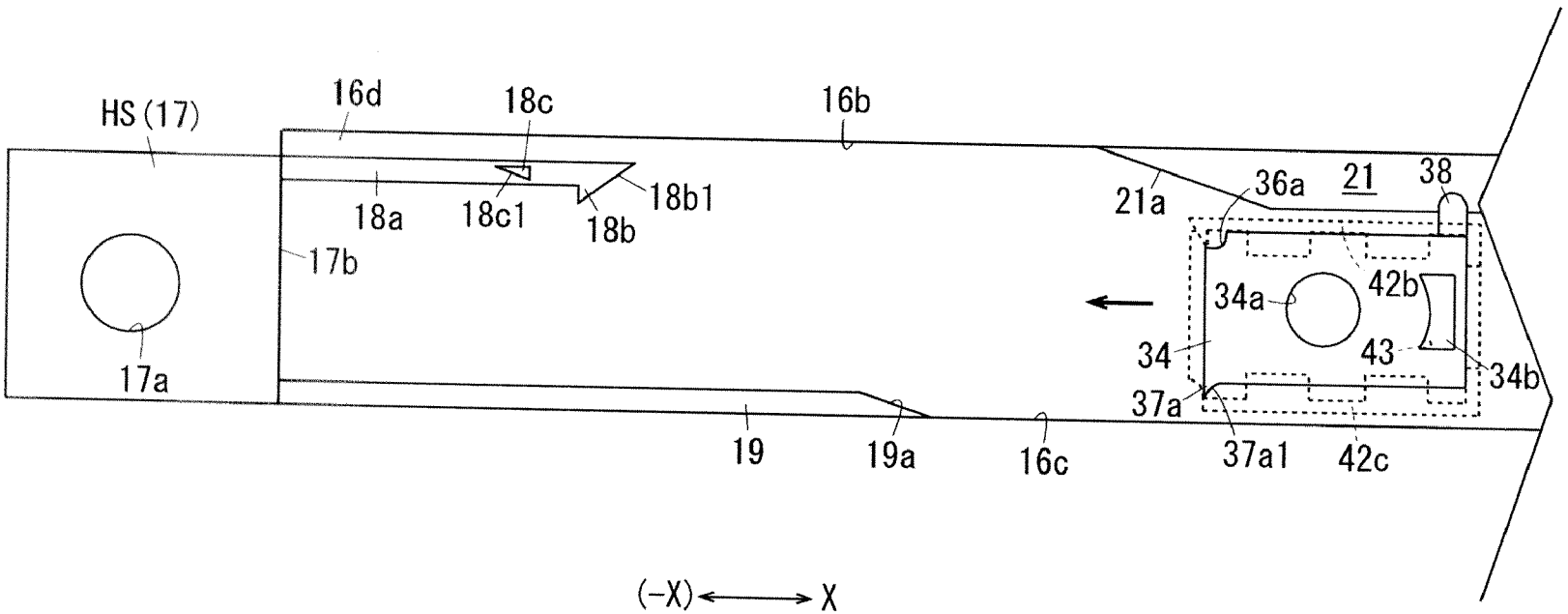
FIG. 14 is an explanatory view of a toner cartridge mounting and removing operation according to the embodiment 1, showing a state after the mounting of the toner cartridge is started.

FIG. 14 is an explanatory view of a cartridge mounting and removing operation according to the embodiment 1, showing a state where the mounting operation of the cartridge is started.

In the description of FIGS. 14~19, in order to facilitate the understanding of the cartridge mounting and removing operation, illustration and description will be given below only of the flow-out opening guide portion 11 of the toner cartridge mounting portion 1*y*, the flow-out opening forming portion 34 of the toner cartridge mounting portion 1*y*, and shutter 42. Also, for easy understanding, the flow-out opening forming portion 34 of the toner cartridge mounting portion 1*y* is shown by a solid line, while the shutter 42 is shown by a broken line.

In FIGS. 4 and 14, when the toner cartridge Ky is inserted into the toner cartridge mounting portion 1*y*, the toner cartridge Ky with the shutter 42 held at the closed position is moved in the backward direction which is the cartridge mounting direction. In FIGS. 4, 5 and 14, at the then time, the guided portion 39 of the toner cartridge Ky is moved backwardly while it is guided by the container guide portion 12 of the image forming apparatus main body U1. In this case, as shown in FIG. 14, the guided portion 39 is guided in such a manner that the left side wall 42*c* of the shutter 42 moves along the left side wall 16*c* of the main guide passage 16. In FIG. 14, since the height of the right guide portion 21 is set substantially the same as the thickness of the shutter main body 42*a* of the shutter 42, the removing projection 38 does not interfere with the right guide portion 21 but passes upwardly thereof. That is, according to the embodiment 1, in the main guide passage 16, only the shutter 42 is guided by the guide portions 19 and 21.

Figure 15:
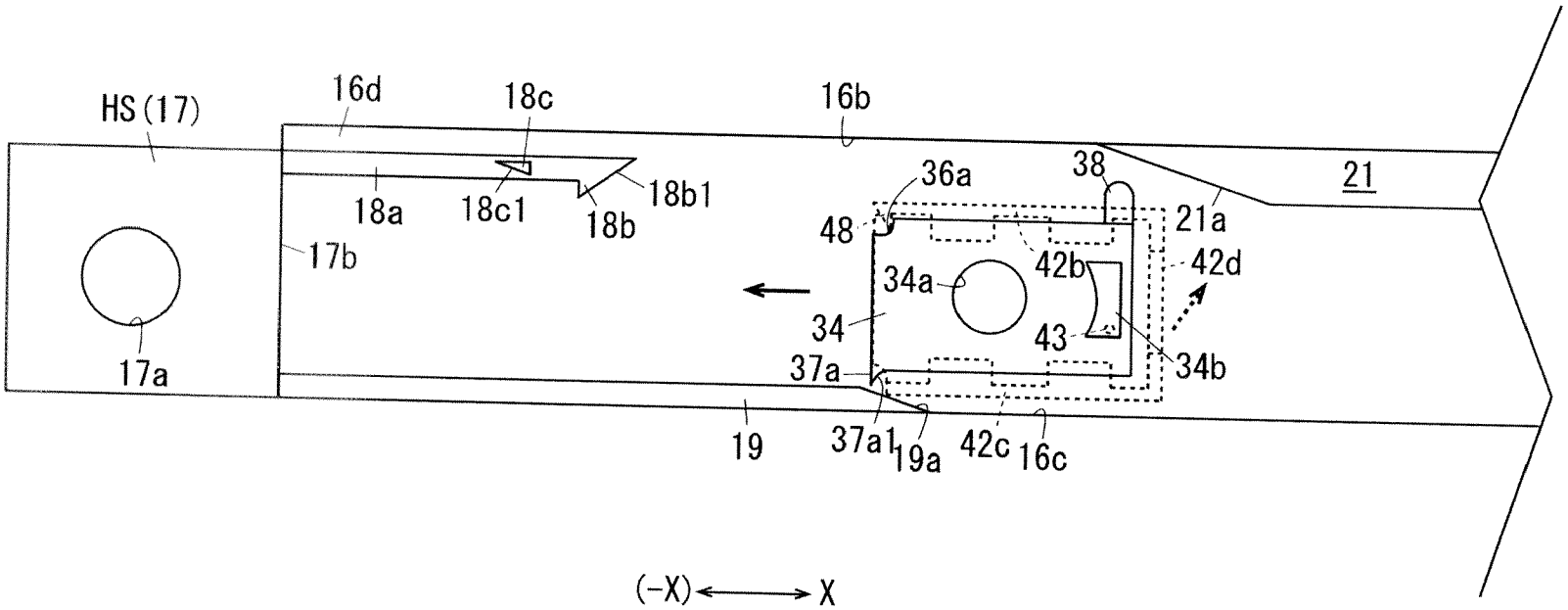
FIG. 15 is an explanatory view of the toner cartridge mounting and removing operation according to the embodiment 1, showing a state where the toner cartridge is inserted further from the state shown in FIG. 14 and the shutter is guided in contact with a mounting time shutter guide surface.

FIG. 15 is an explanatory view of the toner cartridge mounting and removing operation according to the embodiment 1, that is, an explanatory view of a state where the toner cartridge is inserted from the state shown in FIG. 14 and the stutter is guided while in contact with a mounting time shutter guide surface.

In FIGS. 14 and 15, when the toner cartridge Ky is inserted further from the state shown in FIG. 14, the front end of the left side wall 42*c* of the shutter 42 is contacted with the mounting time shutter guide surface 19*a*. In this state, when the toner cartridge Ky is inserted further, the shutter 42 is guided along the mounting time shutter guide surface 19*a* and is thereby moved in the shutter moving direction and in the shutter width direction with respect to the flow-out opening forming portion 34. Therefore, as shown in FIGS. 15 and 11C, the shutter 42 is moved from the closed position to the opening start position.

Figure 16:
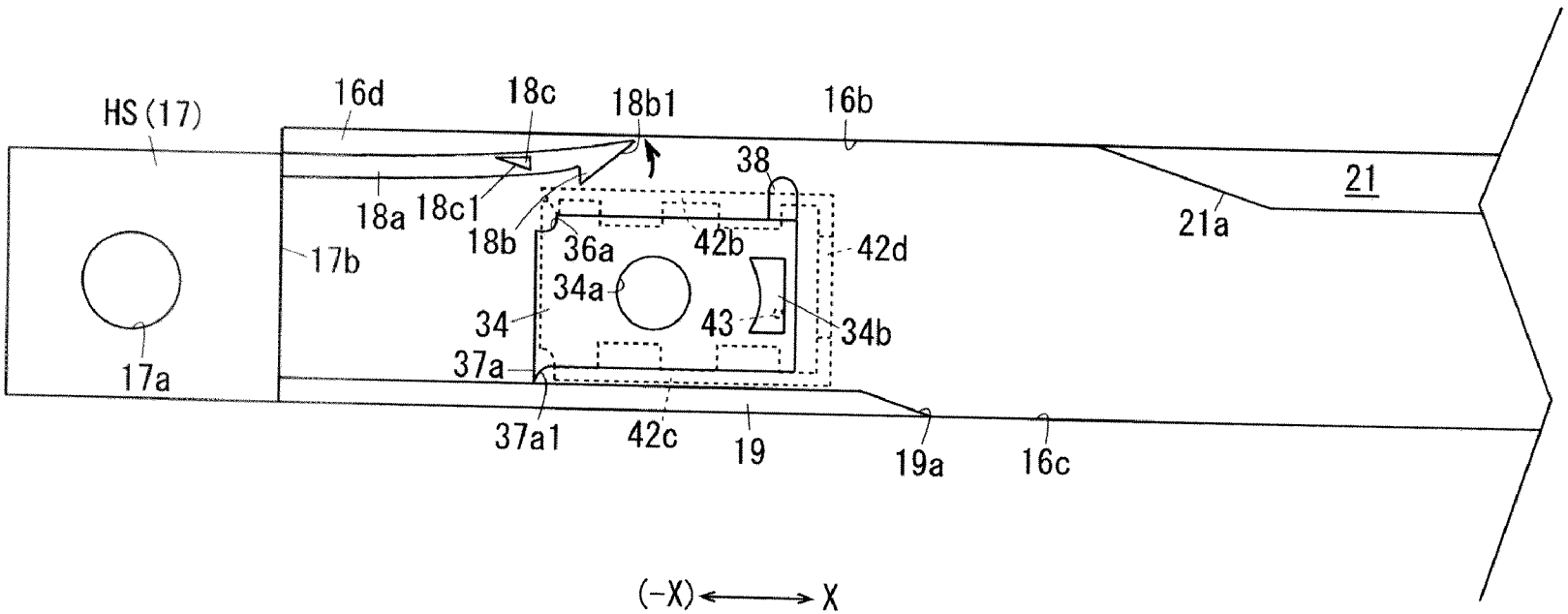
FIG. 16 is an explanatory view of the toner cartridge mounting and removing operation according to the embodiment 1, showing a state where the toner cartridge is inserted still further from the state shown in FIG. 15 and the shutter is contacted with a shutter hold member.

FIG. 16 is an explanatory view of the toner cartridge mounting and removing operation according to the embodiment 1, that is, an explanatory view of a state where the toner cartridge is inserted from the state shown in FIG. 15 and the shutter is contacted with the shutter hold member.

In FIGS. 15 and 16, when the toner cartridge Ky is inserted further from the state shown in FIG. 15, the left side wall of the shutter 42 is guided along the left guide portion 19 and the right side wall 42*b* of the shutter 42 is contacted with the mounting time elastic deformation guide portion 18*b*1 of the shutter hold member 18. When the toner cartridge Ky is pushed in further from this state, the arm portion 18*a* of the shutter hold member 18 is elastically deformed outwardly, whereby, as shown in FIG. 16, the shutter 42 can be moved in the backward direction.

Figure 17:
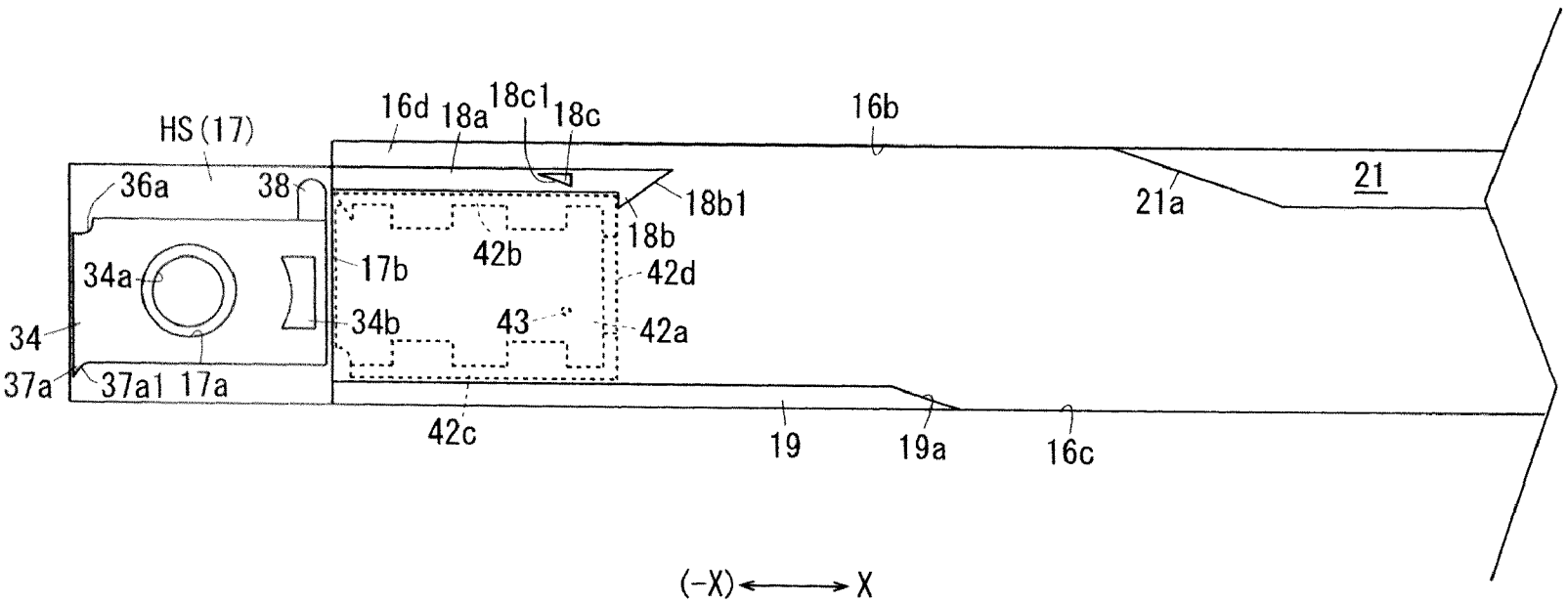
FIG. 17 is an explanatory view of the toner cartridge mounting and removing operation according to the embodiment 1, showing a state where the toner cartridge is inserted further from the state shown in FIG. 16 and the shutter is moved to the opening position.

FIG. 17 is an explanatory view of the toner cartridge mounting and removing operation according to the embodiment 1, that is, an explanatory view of a state where the toner cartridge is inserted from the state shown in FIG. 16 and the shutter is moved to the opening position.

In FIGS. 16 and 17, when the toner cartridge Ky is inserted further from the state shown in FIG. 17, the rear end of the shutter main body 42*a* is contacted with the front end face 17*b* of the flow-in opening portion 17 to thereby restrict the backward movement of the shutter 42. Therefore, when the toner cartridge Ky is inserted further backwardly from this state, the movement of the shutter 42 is stopped and the flow-out opening forming portion 34 is moved backwardly, whereby the shutter 42 shown in FIG. 17 is relatively moved to the opening position. Thus, the flow-out opening 34*a* is opened and is thereby brought into communication with the flow-in opening 17*a*, which completes the mounting process of the toner cartridge Ky.

Here, in FIGS. 16 and 17, the shutter hold member 18 elastically restores from the elastically deformed state, and the hold pawl portion 18*b* is caught by the front end face of the shutter 42. Therefore, the shutter 42 is held in a state where it is prevented from moving in the back and forth direction which is the cartridge mounting and removing direction.

(Description of Cartridge Removing Process)

Figure 18:
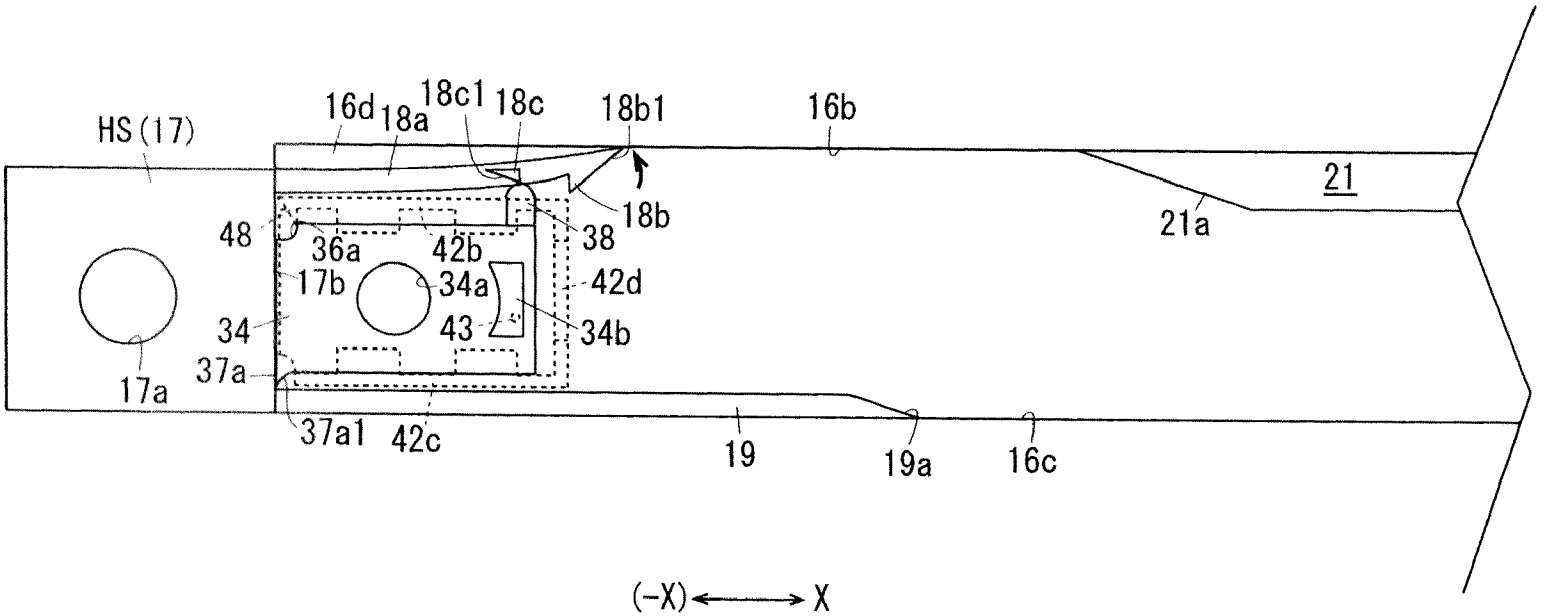
FIG. 18 is an explanatory view of the toner cartridge mounting and removing operation according to the embodiment 1, showing a state where the toner cartridge is moved in the removing direction from the state shown in FIG. 17, and a removing time contact portion and a removing time contacted portion are contacted with each other.

Now, FIG. 18 is an explanatory view of the toner cartridge mounting and removing operation according to the embodiment 1, that is, an explanatory view of a state where the toner cartridge is moved in the removing direction from the state shown in FIG. 17, whereby a removing time contact portion is contacted with a removing time contacted portion.

In FIGS. 17 and 18, when the toner cartridge Ky is removed, for example, for a reason that the image forming material stored in the interior of the toner cartridge Ky is empty, the removal of the toner cartridge Ky is started from the state shown in FIG. 17 in the forward direction which is the removing direction. In this case, since the shutter 42 is locked by the hold pawl portion 18*b*, the shutter 42 is not moved backwardly but the flow-out opening forming portion 34 is moved forwardly, so that the shutter 42 is relatively moved from the opening position to the opening start position. In FIG. 18, as the shutter 42 moves to the opening start position, the removing projection 38 is contacted with the removing contact surface 18*c*1 of the removing time contacted portion 18 which projects upwardly. When the toner cartridge Ky is removed further forwardly from the state where the removing projection 38 and removing contact surface 18*c*1 are contacted with each other, the arm portion 18*a* of the removing time contacted portion 18 is elastically deformed outwardly, thereby removing the locking state of the shutter 42 by the hold pawl portion 18*b*. Therefore, with the forward movement of the toner cartridge Ky, the shutter 42 also starts to move forwardly.

Figure 19:
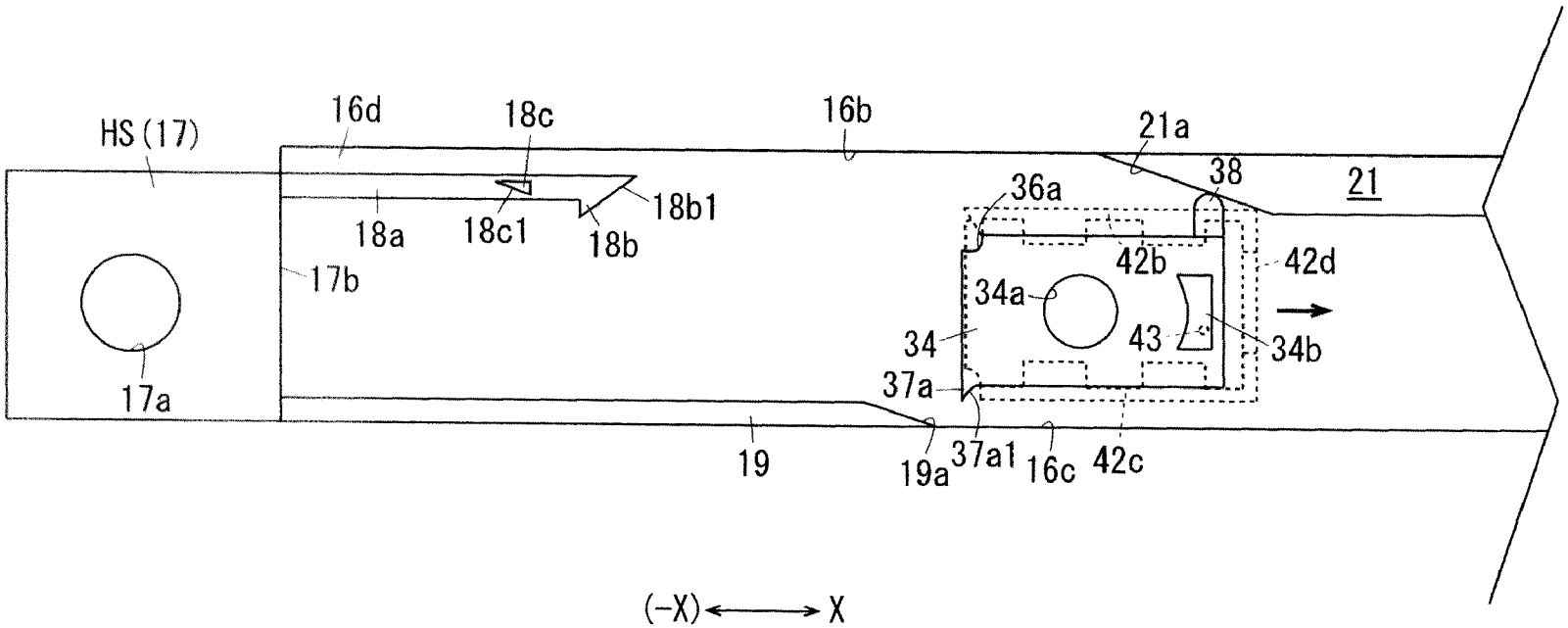
FIG. 19 is an explanatory view of the toner cartridge mounting and removing operation according to the embodiment 1, showing a state where the toner cartridge is moved further in the removing direction from the state shown in FIG. 18 and the shutter is contacted with a right guide portion.

Now, FIG. 19 is an explanatory view of the toner cartridge mounting and removing operation according to the embodiment 1, that is, an explanatory view of a state where the toner cartridge is moved further in the removing direction from the state shown in FIG. 18 and the shutter is contacted with the right guide portion.

In FIGS. 18 and 19, when the toner cartridge Ky is removed further from the state shown in FIG. 18, the front end of the right side wall 42*c* of the shutter 42 is contacted with the removing time shutter guide surface 21*a* of the right guide portion 21. In a state where the front end of she shutter 42 is contacted with the removing time shutter guide surface 21*a*, when the toner cartridge Ky is removed further forwardly, not only the shutter 42 is guided by the removing time shutter guide surface 21*a* which is inclined but also the front end of the left side wall 42*c* of the shutter 42 is guided by a closing time guide surface 37*a*1, whereby the shutter 42 is relatively moved with respect to the flow-out opening forming portion 34. As a result of this, the shutter 42 is relatively moved from the opening start position to the closing position. And, when the toner cartridge Ky is removed still further, the toner cartridge Ky is removed to the outside of the image forming apparatus main body U1 through the state shown in FIG. 14.

Operation of Embodiment 1

In the image forming apparatus U including the above-mentioned structure conditions according to the embodiment 1, when handling the toner cartridge Ky that is to be mounted onto and removed from the image forming apparatus main body U1, if the shutter 42 is contacted with a desk or the like due to the wrong handling of the toner cartridge Ky, the shutter 42 receives an external force which moves the shutter 42 in the shutter moving direction. In this case, the shutter movement restricting pawl portion 48 is caught by the shutter movement restricting recess portion 36*a*, which prevents the shutter 42 from being opened. Also, let us assume here that the shutter 42 receives an external force which includes a direction component for pressing the shutter 42 in the toner flow-out direction and a direction component for moving the shutter 42 in the shutter moving direction. In a structure which includes neither the movement restricting projection 43 nor the open-close movement restricting recess portion 34*b*, there is raised a possibility that the position of the shutter movement restricting pawl portion 48 can be shifted in the toner flow-out direction with respect to the shutter movement restricting recess portion 36*a* and thus the shutter movement restricting pawl portion 48 cannot be caught by the shutter movement restricting recess portion 36*a*, thereby allowing the flow-out opening 34*a* to be opened. On the other hand, according to the embodiment 1, the movement restricting projection 43 and open-close movement restricting recess portion 34*b* are fitted with each other, thereby preventing the shutter 42 from moving to the opening position. That is, in the shutter 42 according to the embodiment 1, owing to the dual movement restriction, that is, owing to the movement restriction provided by the shutter movement restricting pawl portion 48 and shutter movement restricting recess portion 36*a* as well as owing to the movement restriction provided by the movement restricting projection 43 and open-close movement restricting recess portion 34*b*, there is reduced the possibility that the shutter 42 can be moved in error to the opening position.

Therefore, for example, in mounting the toner cartridge Ky onto the toner cartridge mounting portion 1*y*, even when the rear end of the toner cartridge Ky with the shutter 42 mounted thereon is contacted with the edge of the toner cartridge mounting portion 1*y* and thus the shutter 42 receives an external force including two direction components in the toner flow-out direction and in the shutter moving direction, there is reduced the possibility that the flow-out opening 34*a* can be opened to thereby allow the leakage of the toner stored in the toner cartridge 1*y*. Also, even in a state where the shutter 42 is moved to the opening start position or the movement restricting position, the movement restricting projection 43 and open-close movement restricting recess portion cooperate together in preventing the shutter 42 against movement, thereby being able to reduce the leakage of the toner that can be caused by the movement of the shutter 42.

Figure 20A:
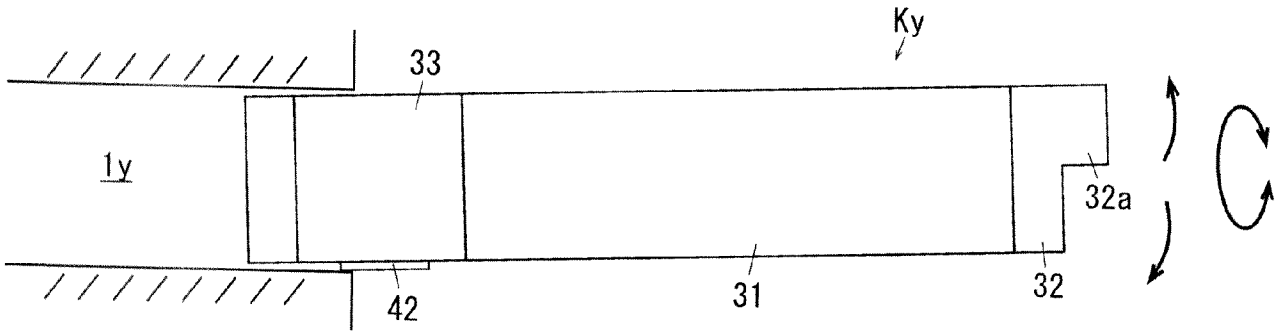
FIG. 20A is an explanatory view of a state where the shutter is contacted with the edge of the shutter mounting portion and an external force is thereby applied to the shutter.
Figure 20B:
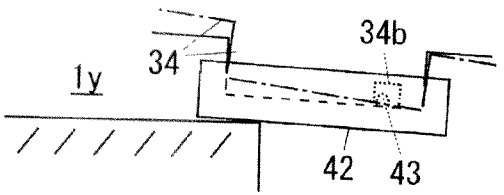
FIG. 20B is an enlarged view of the main portions of FIG. 20A; and, FIG. 20C is an explanatory view of a state where a force for rotating the shutter in the axial direction of the toner-cartridge is applied to the shutter.
Figure 20C:
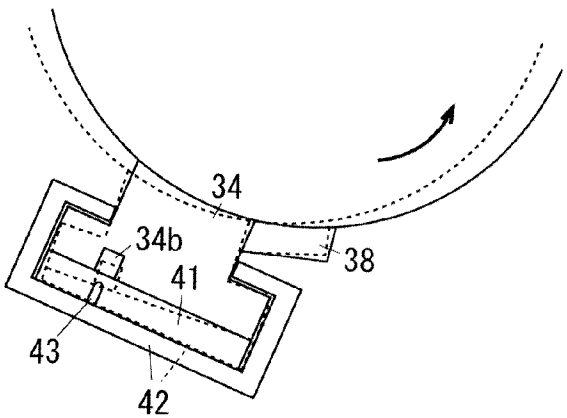
FIG. 20 is an explanatory view of the operation of the embodiment 1, specifically.
Figure 21A:
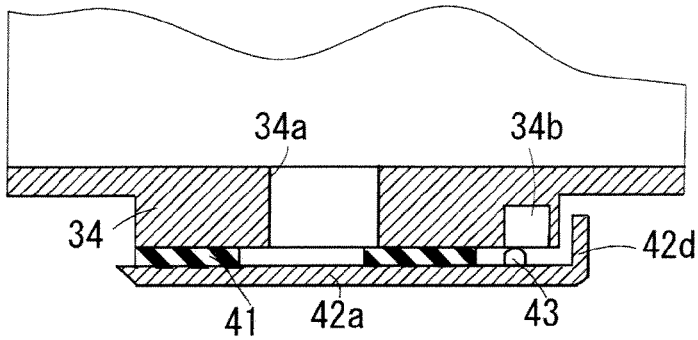
FIG. 21A is a section view corresponding to FIG. 12A according to the embodiment 1, showing a state where the shutter is moved to the closing position.
Figure 21B:
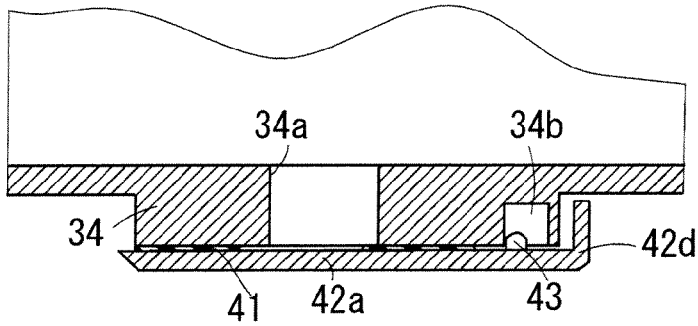
FIG. 21B is a section view corresponding to FIG. 12B according to the embodiment 1, showing a state where the shutter, at the closed position, receives a force for pressing the shutter from outside.
Figure 21C:
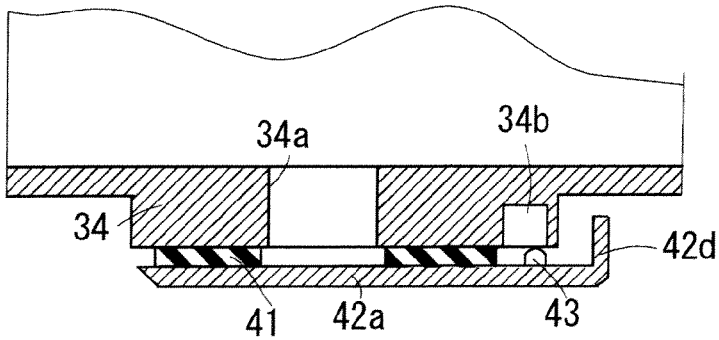
FIG. 21C is a section view corresponding to FIG. 13A according to the embodiment 1, showing a state where the shutter is moved to the movement restricting position or to the opening start position; and, FIG. 21D is a section view corresponding to FIG. 13B according to the embodiment 1, showing a state where the shutter is moved to the movement restricting position or to the opening start position.
Figure 21D:
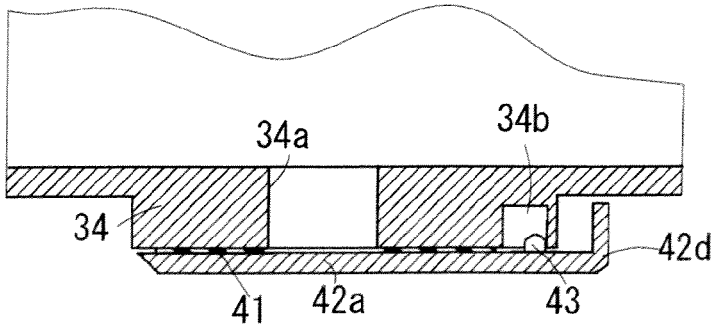
FIG. 21 is an explanatory section view of the main portions of the shutter according to an embodiment 2 of the invention, specifically.

Now, FIG. 20 is an explanatory view of the operation of the embodiment 1. Specifically, FIG. 20A is an explanatory view of a state where the shutter is contacted with the edge of the shutter mounting portion to thereby receive an external force; FIG. 20B is an enlarged view of the main portions of FIG. 20A; and, FIG. 20C is an explanatory view of a state where a force for rotating the shutter in the axial direction of the toner cartridge is applied to the shutter.

In FIGS. 20A and 20B, in a state where the shutter 42 is contacted with the edge of the toner cartridge mounting portion 1*y*, there is raised a possibility of a user operating the toner cartridge Ky in such a manner that it is inclined with the shutter 42 as a fulcrum. In this case, when the grip portion 32*a* of the toner cartridge Ky is moved upward with the shutter 42 as a fulcrum, the shaky motion of the toner cartridge Ky is small; and, on the other hand, when the grip portion 32*a* is moved downward, it can be moved relatively greatly.

Therefore, in a state where the toner cartridge Ky is mounted in the toner cartridge mounting portion 1*y*, as shown in FIG. 20B, there is raised a high possibility that the grip portion 32*a* can be moved downward. In this case, in a state where the shutter 42 is pressed against the edge of the toner cartridge mounting portion 1*y* or the like and is thereby difficult to move, as shown by a one-dot chained line in FIG. 20B, the flow-out opening forming portion 34 is inclined with respect to the shutter 42 and is pressed against the front side of the shutter 42, whereby the seal member 41 is inclined in a state where it is elastically deformed. In correspondence to this, in the image forming apparatus U according to the embodiment 1, the movement restricting projection 43 and open-close movement restricting recess portion 34*b* are disposed on the opening position side of the flow-out opening 34*a*, that is, on the front side thereof along the shutter moving direction. In other words, in a structure where the movement restricting projection 43 and open-close movement restricting recess portion 34*b* are disposed on the rear side of the flow-out opening 34*a*, when the shutter 42 is inclined while the front side thereof is pressed, the rear side thereof is easy to float when compared with the front side thereof, whereby the movement restricting projection 43 and open-close movement restricting recess portion 34*b* are difficult to be fitted with each other. On the other hand, according to the embodiment 1 where the movement restricting projection 43 and open-close movement restricting recess portion 34*b* are disposed on the front side of the flow-out opening 34*a*, even when the shutter 42 is inclined while the front side thereof is pressed, the movement restricting projection 43 and open-close movement restricting recess portion 34*b* are positively easy to be fitted with each other, which makes it easy to restrict the wrong opening of the shutter 42.

In FIG. 20C, according to the embodiment 1, on the right of the flow-out opening forming portion 34, there is disposed a removing projection 38; and, in a state where the shutter 42 is contacted with the toner cartridge mounting portion 1*y* or the like, in some cases, to the flow-out opening forming portion 34, there can be applied an external force which rotates the flow-out opening forming portion 34 about the axial direction of the toner cartridge Ky with the shutter 42 as a fulcrum. At the then time, when there is applied a clockwise external force in FIG. 20C, in a state where the shutter 42 is pressed against the edge of the toner cartridge mounting portion 1*y* or the like, the seal member 41 is elastically deformed in such a manner that the flow-out opening forming portion 34 side thereof is inclined with respect to the shutter 42. In this state, the right side wall 42*b* of the shutter 42 is contacted with the removing projection 38 and is thereby prevented from inclining any further. This prevents the removal of the engagement between the movement restricting projection 43 and open-close movement restricting recess portion 34*b*, and thus the possibility of the wrong opening of the shutter 42 can also be reduced.

On the contrary, when there is applied a counterclockwise force in FIG. 20C, since the removing projection 38 is not disposed on the left of the shutter 42, as shown by a broken line in FIG. 20C, the shutter 42 is inclined more greatly when compared with a case where a clockwise external force is applied. On the other hand, according to the embodiment 1, since the movement restricting projection 43 and open-close movement restricting recess portion 34*b* are disposed at positions that are shifted no left, the engagement between the movement restricting projection 43 and open-close movement restricting recess portion 34*b* is not removed but the wrong opening of the shutter 42 can be prevented. That is, whether the external force applied is clockwise or counterclockwise, the engagement between the movement restricting projection 43 and open-close movement restricting recess portion 34*b* is difficult to remove and thus the possibility of the wrong opening of the shutter 42 can be reduced.

Embodiment 2

Next, description will be given below of an embodiment 2 according to the invention. In the following description of the embodiment 2, the composing elements of the embodiment 1, which correspond to the composing elements of the embodiment 1, are given the same reference numerals and signs and thus the detailed description thereof is omitted.

This embodiment 2 is different from the above-mentioned embodiment 1 in the following aspects but it is structured similarly to the embodiment 1 in other aspects.

FIG. 21 is an explanatory section view of the main portions of a shutter employed in the embodiment 2. Specifically, FIG. 21A corresponds to FIG. 12A according to the embodiment 1, and it is a section view of the shutter, showing a state in which the shutter is moved to the closed position; FIG. 21B corresponds to FIG. 12B according to the embodiment 1, and it is a section view of the shutter, showing a state in which the shutter, at the closed position, receives a force to press the shutter from outside; FIG. 21C corresponds to FIG. 13A according to the embodiment 1, and it is a section view of the shutter, showing a state where the shutter is moved to the movement restricted position or to the opening start position; and, FIG. 21D corresponds to FIG. 13B according to the embodiment 1, and it is a section view of the shutter, showing a state in which the shutter is moved to the movement restricted position or to the opening start position.

In FIG. 21, in an image forming apparatus U according to the embodiment 2, a seal member 41 used as an example of a seal member is bonded on the upper surface of the shutter main body 42*a* of the shutter 42 not on the flow-out opening forming portion 34. Therefore, as shown in FIGS. 21A and 21C, with the movement of the shutter 42, the seal member 41 is also moves.

Operation of Embodiment 2

In the above-structured image forming apparatus according to the embodiment 2, similarly to the embodiment 1, the engagement between the movement restricting projection 43 and open-close movement restricting recess portion 34*b* restricts the movement of the shutter 42, thereby reducing the wrong opening of the shutter 42.

Embodiment 3

Next, description will be given below of an embodiment 3 according to the invention. In the following description of the embodiment 3, the composing elements of the embodiment 3, which correspond to the composing elements of the embodiment 1, are given the same reference numerals and signs and thus the detailed description thereof is omitted.

This embodiment 3 is different from the above-mentioned embodiment 1 in the following aspects but it is structured similarly to the embodiment 1 in other aspects.

Figure 22A:
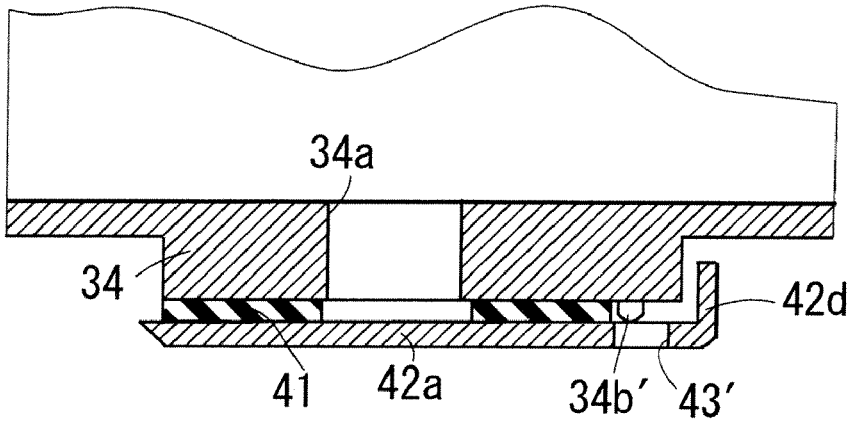
FIG. 22A is a section view corresponding to FIG. 12A according to the embodiment 1, showing a state where the shutter is moved to the closing position; and, FIG. 22B is a section view corresponding to FIG. 12B according to the embodiment 1, showing a state where the shutter, at the closed position, receives a force for pressing the shutter from outside.
Figure 22B:
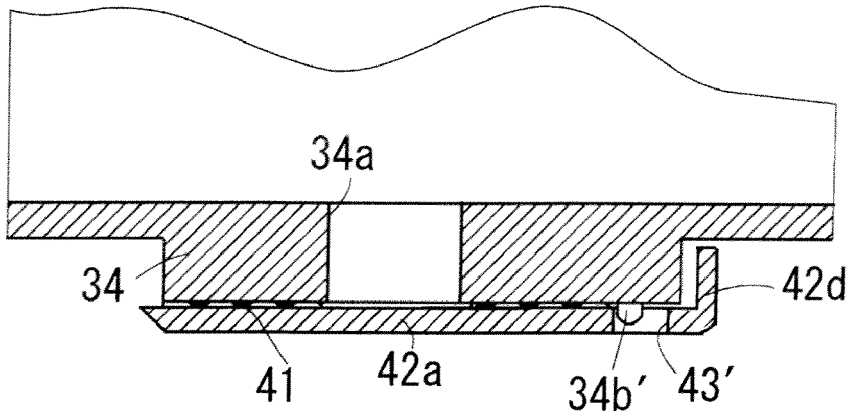
FIG. 22 is an explanatory section view of the main portions of a shutter according to an embodiment 3 of the invention, specifically.

FIG. 22 is an explanatory section view of the main portions of a shutter employed in the embodiment 3. Specifically, FIG. 22A corresponds to FIG. 12A according to the embodiment 1, and it is a section view of the shutter, showing a state in which the shutter is moved to the closing position; and, FIG. 22B corresponds to FIG. 12B according to the embodiment 1, and it is a section view of the shutter, snowing a state in which the shutter, at the closed position, receives a force to press the shutter from outside.

In FIG. 22, in the image forming apparatus U according to the embodiment 3, instead of the open-close movement restricting recess portion 34*b* and movement restricting projection 43 used in the embodiment 1, there are provided a movement restricting projection 34*b*' serving as an example of an open-close movement restricting portion which projects from the flow-out opening forming portion 34 toward the shutter 42, and a following movement restricting hole 43' serving as an example of a restricting portion formed in the shutter 42.

Operation of Embodiment 3

In the above-structured image forming apparatus according to the embodiment 3, similarly to the embodiment 1, the engagement between the movement restricting projection 34*b*' and following movement restricting hole 43' restricts the movement of the shutter 42, thereby reducing the wrong opening of the shutter 42.

Embodiment 4

Next, description will be given below of an embodiment 4 according to the invention. In the following description of the embodiment 4, the composing elements of the embodiment 4, which correspond to the composing elements of the embodiment 1, are given the same reference numerals and signs and thus the detailed description thereof is omitted.

This embodiment 4 is different from the above-mentioned embodiment 1 in the following aspects but it is structured similarly to the embodiment 1 in other aspects.

Figure 23A:
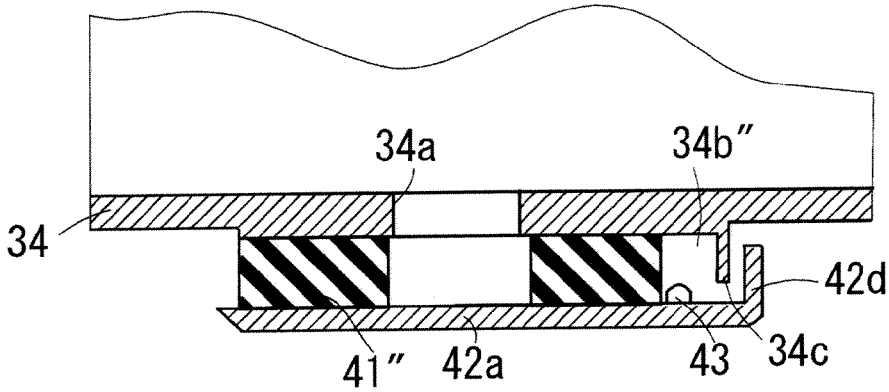
FIG. 23A is a section view corresponding to FIG. 12A according to the embodiment 1, showing a state where the shutter is moved to the closing position; and, FIG. 23B is a section view corresponding to FIG. 12B according to the embodiment 1, showing a state where the shutter, at the closed position, receives a force for pressing the shutter from outside.
Figure 23B:
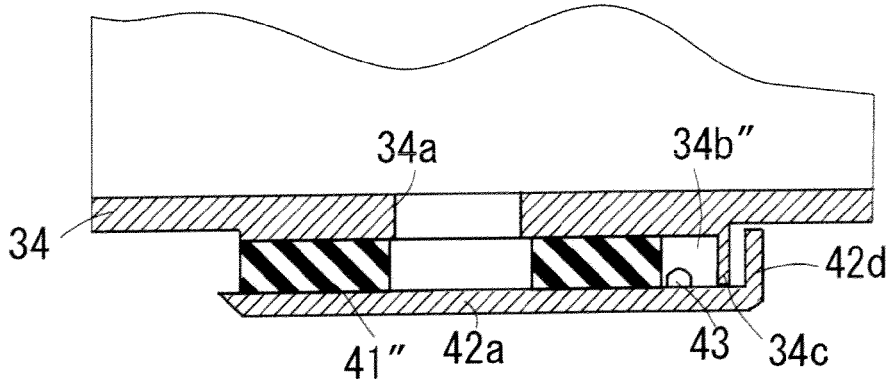
FIG. 23 is an explanatory section view of the main portions of a shutter according to an embodiment 4 of the invention, specifically.

FIG. 23 is an explanatory section view of the main portions of a shutter employed in the embodiment 4. Specifically, FIG. 23A corresponds to FIG. 12A according to the embodiment 1, and it is a section view of the shutter, showing a state in which the shutter is moved to the closing position; and, FIG. 23B corresponds to FIG. 12B according to the embodiment 1, and it is a section view of the shutter, showing a state in which the shutter, at the closed position, receives a force to press the shutter from outside.

In FIG. 23, in the image forming apparatus U according to the embodiment 4, on the lower surface of the flow-out opening forming portion 34, specifically, on the front end portion thereof along the shutter moving direction, there is provided a projecting wall 34*c* which projects toward the shutter 42. Also, on the lower surface of the flow-out opening forming portion 34, there is fixed and supported a seal member 41" formed greater in height than the projecting wall 34*c*; and, between the front end of the seal member 41" and projecting wall 34*c*, there is interposed an open-close movement restricting space 34*b*" which is used as an example of an open-close restricting portion.

Operation of Embodiment 4

In the above-structured image forming apparatus according to the embodiment 4, similarly to the embodiment 1, the engagement between the open-close movement restricting space 34*b*" and movement restricting projection 43 restricts the movement of the shutter 42, thereby reducing the wrong opening of the shutter 42.

MODIFICATIONS

Although description has been given heretofore in detail of the embodiments according to the invention, the invention is not limited to these embodiments but various changes are also possible without departing from the scope of the subject matter of the invention stated in the scope of the patent claims. The followings are the modifications (H01)~(H06) according to the invention.

(H01) In the above-mentioned embodiments, as an example of an image forming apparatus, there has been shown a copying machine. However, this is not limitative but there may also be used a FAX or a printer, or a composite machine including all functions of the copying machine, FAX and printer or two or more functions thereof. Also, in the above embodiments, there has been shown the image forming apparatus which includes the image holders PRy~PRk, developing devices Gy~Gk and latent image forming devices LHy~LHk respectively corresponding to four colors. However, the invention is not limited to this but the invention can also apply to an image forming apparatus for a monochrome and a rotation type of image forming apparatus which includes a single image holder, a single latent image forming device and four developing devices sequentially so rotatable as to be opposed to the image holder.

(H02) In the above-mentioned embodiments, the removing projection 38 is disposed on the right side. However, the removing projection 38 may also be disposed on the left side, or two removing projections 38 may also be disposed on both of right and left sides. In correspondence to this, the movement restricting projection 43 may also be disposed shifted to right or may also be disposed in the central portion. By the way, in the toner cartridges 1*y*~1*k* according to the embodiment 1 each of which includes the flow-out opening forming portion 34 extending in the left downward direction, when the removing projection 38 is disposed on the left side, in a state where the shutter 42 is put on a desk or the like, there is applied an external force for rotating the shutter 42 in the axial direction of the toner cartridge, whereby the shutter 42 receives a force inclined in such a direction that the shutter 42 can deform the seal member 41 elastically without interfering with the removing projection 38. At the then time, the elastic restoring force increases a friction force, and the thus increased friction force provides resistance to the movement of the shutter 42, thereby reducing the wrong opening of the shutter 42.

(H03) In the above-mentioned embodiments, the movement restricting projection 43 is disposed on the front side. However, it may also be disposed on the rear side.

(H04) In the above-mentioned embodiments, there is illustrated a structure in which the flow-out opening forming portion 34 and shutter 42 are disposed on the rear side of the toner cartridge, that is, on the front side in the cartridge mounting direction. However, the invention is not limited to this structure but it is also possible to employ a structure in which the flow-out opening forming portion 34 is disposed on the rear side or in the central portion in the cartridge mounting direction.

(H05) In the above-mentioned embodiments, preferably, there may be employed a structure in which the movement of the shutter 42 is restricted by the shutter movement restricting pawl portion 48 and shutter movement restricting recess portion 36*a*. However, this structure may also be omitted or may be replaced with a structure for restricting other movements than the movement of the shutter 42, or there may also be added thereto a structure for restricting other movements.

(H06) In the above-mentioned embodiments, the shapes of the movement restricting projection 43 and open-close movement restricting recess portion 34*b* are not limited to those shown in the embodiments, but they may also be changed to other shapes which can restrict the movement of the shutter 42.

(H07) In the above-mentioned embodiments, the seal member 41 is applied to the storage carrier for using the developer which is the powder material, but may be also applied to a storage carrier for using an ink for a type of inkjet, which is the liquid material. If the seal member 41 is applied to the storage carrier for using the ink, the seal member 41 is constituted that a sealing force generated when the seal member 41 seals the shutter main body 42*a* can be alternatively set.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A storage container comprising:

a storage container main body that stores an image forming material therein;

a flow-out opening that flows out the image forming material stored in the storage container main body;

a shutter that is supported to be movable between an opening position, which opens the flow-out opening and a closing position, which closes the flow-out opening;

a seal member that, in a case where the shutter is disposed at the closing position, is interposed between the flow-out opening and the shutter and is elastically deformed by the shutter in a thickness direction thereof along the flow-out direction of the image forming material so as to seal the flow-out opening;

a restricting portion that is supported on the shutter; and an open-close movement restricting portion that, in a state where the shutter is moved to the closing position, is disposed at a position opposed to the restricting portion, and that, in a case where the shutter moved to the closing position is pressed from outside and the seal member is thereby elastically deformed further in the thickness direction, is disposed at a position overlapping with the leading end position of the restricting portion along a moving direction of the shutter and, in a case where no external force is applied to the shutter, is disposed at a position not overlapping with the leading end position of the restricting portion along the moving direction of the shutter.

2. A storage container comprising:

a storage container main body that stores an image forming material therein;

a flow-out opening for flowing out the image forming material stored in the storage container main body;

a shutter that is supported to be movable between an opening position, which opening the flow-out opening and a closing position, which closing the flow-out opening;

a seal member that, in a case where the shutter is disposed at the closing position, is interposed between the flow-out opening and the shutter and is elastically deformed by the shutter in a thickness direction thereof along the flow-out direction of the image forming material so as to seal the flow-out opening;

a restricting portion that is supported on the shutter; and an open-close movement restricting portion that is disposed at a position opposed to the restricting portion in a state where the shutter is moved to the closing position, wherein, in a case where the shutter moved to the closing position is pressed from outside and the seal member is thereby elastically deformed further in the thickness direction, a leading end position of the open-close movement restricting portion is disposed at a position overlapping with the restricting portion along a moving direction of the shutter and, in a case where no external force is applied to the shutter, the leading end position of the open-close movement restricting portion is disposed at a position not overlapping with the restricting portion along the moving direction of the shutter.

3. A storage container comprising:

a storage container main body that stores an image forming material therein;

a flow-out opening that flows out the image forming material stored in the storage container main body;

a shutter that is supported to be movable between an opening position, which opens the flow-out opening and a closing position, which closes the flow-out opening;

a seal member that is supported in the vicinity of the flow-out opening and can be elastically deformed in a thickness direction thereof along the flow-out direction of the image forming material by the shutter so as to seal the flow-out opening;

a restricting portion that is supported on the shutter; and an open-close movement restricting portion that, in a state where the shutter is moved to the closing position, is disposed at a position opposed to the restricting portion, and also which, in a case where the shutter moved to the closing position is pressed from outside and the seal member is thereby elastically deformed further in the thickness direction, is engaged with the restricting portion to thereby restrict the movement of the shutter.

4. The storage container as claimed in claim 1, wherein, in a case where the seal member is disposed at the closing position, the restricting portion is disposed with respect to the flow-out opening on the side of the opening position along the moving direction of the shutter, and the open-close movement restricting portion is disposed on a side of the opening position along the moving direction of the shutter with respect to the flow-out opening.

5. The storage container as claimed in claim 1, further comprising:

an open-close member contact portion that extends, with respect to the flow-out opening, in a direction of one of first and second sides perpendicular to the moving direction of the shutter, the open-close member contact portion, in a case where the seal member is elastically deformed further in the thickness direction, being contactable with the shutter, wherein the restricting portion is disposed such that a first distance between the restricting portion and a first side is shorter than a second distance between the restricting portion and a second side where the open-close member contact portion is disposed.

6. An image forming apparatus comprising:

an image holder;

a developing device that develops a latent image formed on the surface of the image holder to a visible image; and a storage container according to claim 1 in which an image forming material to be supplied to the developing device is stored.

* * * * *